US007410002B2

(12) United States Patent
Khazanovich et al.

(10) Patent No.: US 7,410,002 B2
(45) Date of Patent: Aug. 12, 2008

(54) METHOD AND APPARATUS TO PROVIDE ELECTRICAL CONNECTION IN A WELLHEAD FOR A DOWNHOLE ELECTRICAL DEVICE

(75) Inventors: Abram Khazanovich, Edmonton (CA); Irina Khazanovich, Edmonton (CA); Nathan Kwasniewski, Sherwood Park (CA)

(73) Assignee: Stream-Flo Industries, Ltd., Edmonton, Alberta (CA)

( * ) Notice: Subject to any disclaimer, the term of this patent is extended or adjusted under 35 U.S.C. 154(b) by 258 days.

(21) Appl. No.: 10/913,710

(22) Filed: Aug. 5, 2004

(65) Prior Publication Data

US 2005/0051341 A1 Mar. 10, 2005

Related U.S. Application Data

(60) Provisional application No. 60/493,097, filed on Aug. 5, 2003.

(51) Int. Cl.
*E21B 23/00* (2006.01)

(52) U.S. Cl. ..... 166/382; 166/379; 166/65.1

(58) Field of Classification Search ..... 166/379, 166/382, 85.1, 65.1, 75.14
See application file for complete search history.

(56) References Cited

U.S. PATENT DOCUMENTS

| | | | | |
|---|---|---|---|---|
| 2,548,360 | A | 4/1951 | Germain | 166/60 |
| 2,597,261 | A | 5/1952 | Rhoads | 392/311 |
| 2,634,961 | A | 4/1953 | Ljungstrom | 166/302 |
| 2,728,396 | A | 12/1955 | Carpenter | 166/60 |
| 2,732,195 | A | 1/1956 | Ljungstrom | 166/302 |
| 2,780,450 | A | 2/1957 | Ljungstrom | 166/258 |
| 2,789,805 | A | 4/1957 | Ljungstrom | 166/302 |
| 2,812,818 | A | 11/1957 | Brusco | 166/60 |
| 2,923,535 | A | 2/1960 | Ljungstrom | 166/256 |
| 2,982,354 | A | 5/1961 | Green | 166/60 |
| 3,294,169 | A | 12/1966 | O'Brien | 166/294 |
| 3,638,732 | A | 2/1972 | Huntsinger et al. | |
| 4,491,176 | A | 1/1985 | Reed | 166/65 |
| 4,500,263 | A | 2/1985 | Mohn | 417/360 |
| 4,570,715 | A | 2/1986 | Van Meurs et al. | 166/302 |
| 4,627,489 | A | 12/1986 | Reed | 166/65.1 |
| 4,716,960 | A * | 1/1988 | Eastlund et al. | 166/60 |
| 4,886,114 | A * | 12/1989 | Perkins et al. | 166/66.7 |

(Continued)

OTHER PUBLICATIONS

"Specification for Wellhead and Christmas Tree Equipment," ANSI/API Specification 6A, Nineteenth Edition, Jul. 2004.

*Primary Examiner*—David J. Bagnell
*Assistant Examiner*—Brad Harcourt
(74) *Attorney, Agent, or Firm*—Greenlee, Winner and Sullivan, P.C.

(57) ABSTRACT

Wellhead assembly and method for providing power connection to downhole electrical device. Wellhead body members support vertically stacked isolated tubing hanger and grounding tubing hanger. The isolated tubing hanger suspends a conducting tubing string, while the grounding tubing hanger suspends a grounding tubing string concentrically spaced from the conducting tubing string. The isolated tubing hanger has an outer housing, an inner electrically conducting portion supported by the outer housing to provide electrical connection with, and suspend, the conducting tubing string, and insulation between the housing and conducting portion to electrically isolate the housing. Hot electrical connection is made through a conduit in the wellhead body member, for electrical connection to the conducting tubing string. Grounding connection is provided to the wellhead body members.

26 Claims, 23 Drawing Sheets

U.S. PATENT DOCUMENTS

| | | | | |
|---|---|---|---|---|
| 4,886,118 | A | 12/1989 | Van Meurs et al. | 166/245 |
| 4,923,006 | A | 5/1990 | Hartmann et al. | 166/65 |
| 5,060,287 | A | 10/1991 | Van Egmond | 392/301 |
| 5,065,818 | A | 11/1991 | Van Egmond | 166/60 |
| 5,280,766 | A | 1/1994 | Mohn | 166/368 |
| 5,544,707 | A | 8/1996 | Hopper et al. | 166/382 |
| 5,558,532 | A | 9/1996 | Hopper | 439/310 |
| 5,794,693 | A | 8/1998 | Wright et al. | 166/85.5 |
| 6,023,554 | A | 2/2000 | Vinegar et al. | 392/301 |
| 6,039,119 | A | 3/2000 | Hopper et al. | 166/368 |
| 6,112,808 | A | 9/2000 | Isted | 166/60 |
| 6,200,152 | B1 | 3/2001 | Hopper | 439/310 |
| 6,269,876 | B1 | 8/2001 | De Rouffignac et al. | 166/60 |
| 6,360,819 | B1 | 3/2002 | Vinegar | 166/60 |
| 6,581,684 | B2 | 6/2003 | Wellington et al. | 166/245 |
| 6,585,046 | B2 | 7/2003 | Neuroth et al. | |
| 6,588,503 | B2 | 7/2003 | Karanikas et al. | 166/245 |
| 6,588,504 | B2 | 7/2003 | Wellington et al. | 166/245 |
| 6,591,906 | B2 | 7/2003 | Wellington et al. | 166/251.01 |
| 6,591,907 | B2 | 7/2003 | Zhang et al. | 166/250.01 |
| 6,662,875 | B2 | 12/2003 | Bass et al. | 166/369 |
| 6,679,332 | B2 * | 1/2004 | Vinegar et al. | 166/373 |
| 6,681,861 | B2 | 1/2004 | Davidson et al. | 166/382 |
| 6,686,745 | B2 | 2/2004 | Bass | 324/522 |
| 6,763,882 | B2 | 7/2004 | Demny et al. | 166/208 |
| 6,763,887 | B2 | 7/2004 | Boyadjieff | |
| 7,004,247 | B2 | 2/2006 | Cole et al. | |
| 7,084,782 | B2 | 8/2006 | Davies et al. | |
| 2002/0023751 | A1 | 2/2002 | Neuroth et al. | 166/302 |
| 2004/0060703 | A1 | 4/2004 | Stegemeier et al. | |
| 2007/0018848 | A1 | 1/2007 | Bottos et al. | |

* cited by examiner

METHOD AND APPARATUS TO PROVIDE ELECTRICAL CONNECTION IN A WELLHEAD FOR A DOWNHOLE ELECTRICAL DEVICE

CROSS-REFERENCE TO RELATED APPLICATIONS

This application claims benefit of U.S. Provisional Application No. 60/493,097, filed Aug. 5, 2003, which is incorporated herein in its entirety to the extent not inconsistent herewith.

FIELD OF INVENTION

The invention provides a method and apparatus to provide electrical connection in a wellhead for a downhole electrical device.

BACKGROUND OF THE INVENTION

Power is often needed to be provided to downhole electrical devices such as pumps and heaters. Electrical heaters may be used to heat the subterranean formation by radiation and/or conduction, or the heater may resistively heat an element. U.S. Pat. No. 4,716,960 to Eastlund et al., describes electrically heating of the tubing of a petroleum well by passing a relatively low voltage current through the tubing to prevent formation of solids. U.S. Pat. No. 6,023,554 to Vinegar et al., describes an electrical heating element that is positioned within a casing. The heating element generates radiant energy that heats the casing. A granular solid fill material may be placed between the casing and the formation. The casing may conductively heat the fill material, which in turn conductively heats the formation.

Isolated tubing hangers are known in the oil and gas industry. They are often used when providing an electrical connection to one or more downhole electrical devices such as pumps or electrical instruments. However, for the most part, the power is supplied by electrical cables, which are accommodated through a tubing hanger by feed through connectors which provide electrical isolation from the hanger. Exemplary patents relating to insulated tubing hangers include U.S. Pat. No. 4,923,006 to Hartmann et al. and U.S. Pat. No. 6,763,882, issued Jul. 20, 2002 to Demny et al. (published U.S. Patent Application No. 2004/0089444 May 13, 2004). U.S. Pat. No. 5,280,766 to Mohn describes a subsea wellhead system in which concentric tubular conductors with insulating sleeves therebetween are used to provide power to a pump. Few details for providing the electrical connection are provided.

In general, the prior art patents are not directed to the unique problems associated with the provision of high voltage, high pressure to downhole electrical devices through wellhead tubing strings under pressure-containing and electrical isolating conditions. For instance, the current needed to run downhole instrumentation, pumps or even to heat a tubing to prevent a wax build up, is minor compared to that needed to run downhole heaters in heavy oil reservoirs.

As well, the patents relating to isolated tubing hangers suffer the disadvantage of not providing a feature for making an electrical connection at the wellhead when the well is under pressure.

SUMMARY OF THE INVENTION

In a broad aspect, the invention provides a wellhead assembly for providing a power connection to a downhole electrical device, including:

a) one or more pressure-containing wellhead body members, preferably a plurality, enclosing a vertical wellbore extending there through, the body members forming separate first and second tubing hanger profiles to support in sealed and vertically stacked relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being formed of an electrically conductive material and being electrically connected to the downhole electrical device;

b) the isolated tubing hanger having an outer housing which seats in the first tubing hanger profile, an inner electrically conducting portion supported by the outer housing operative to provide electrical connection to, and suspend, the conducting tubing string, and insulation between the housing and the conducting portion to electrically isolate the housing portion from the conducting portion;

c) one of the Wellhead body members forming a conduit to provide access to the vertical wellbore proximate the isolated tubing hanger;

d) hot electrical connection extending through the conduit, for making an electrical connection through to the conducting tubing string in the vertical wellbore;

e) electrical isolation associated with the hot electrical connection for sealing and electrically isolating the hot electrical connection in the conduit such that the one or more wellhead body members remain electrically isolated;

f) grounding connection connected to the one or more wellhead body members proximate the grounding tubing hanger for making a ground connection to the grounding tubing string; and g) a source of current having a first connection to the hot electrical connection and a second connection to the grounding connection means.

The invention also broadly extends to a hot electrical connection assembly in a wellhead for providing a power source to a downhole electrical device, in which the hot electrical connection comprises a conductive rod connected at one end to a source of current, and at the other end to a conducting clamp assembly, said clamp assembly being operative to clamp together, for electrical connection within the vertical wellbore, the conductive rod and either the conducting tubing string or the conducting portion of the isolated tubing hanger. The clamp assembly may connect to either the conducting portion of the isolated tubing hanger or the conducting tubing string itself, and either above or below the isolated tubing hanger, but most preferably, the clamp assembly connects the conductive rod to an upwardly extending conducting neck portion of the isolated tubing hanger.

The invention also broadly extends to a hot electrical connection assembly in a wellhead for providing a power source to a downhole electrical device, in which the hot electrical connection comprises at least one reciprocating horizontal ram in the conduit, the ram having a conductive rod end connected to a source of current and a ram end to make the electrical connection to the conducting tubing string when in an extended position, and to break the electrical connection when in a retracted position. The horizontal ram may make an electrical connection to either the conducting portion of the isolated tubing hanger or the conducting tubing string itself, and either above or below the tubing hanger, but most preferably, the horizontal ram makes the electrical connection to a downwardly extending conducting neck portion of the isolated tubing hanger.

The present invention also extends to an isolated tubing hanger for suspending a conducting tubing string within a tubing head. The isolated tubing hanger comprises:

an outer housing which seats in the tubing head, an inner electrically conducting portion supported by the outer housing operative to provide electrical connection to, and suspend, the conducting tubing string, and insulation between the housing and the conducting portion to electrically isolate the housing portion from the conducting portion;

the housing forming a central bore with an inwardly extending circumferential landing seat at its lower end, and carrying outer circumferential seals to seal with the tubing head;

the conducting portion of the isolated tubing hanger including a landing shoulder to seat on the landing seat, a central bore extending there through and having a profile to support and seal therein a back pressure valve, and a conducting neck portion integral with the conducting portion extending upwardly or downwardly relative to the housing, said neck portion providing the electrical connection to the conducting tubing string;

the insulation including load supporting insulation plates located above and below the landing shoulder, and a plurality of insulation sleeves between the housing and the conducting portion;

one or more seals between the landing shoulder and the landing seat to seal the conducting portion of the isolated tubing hanger with the housing; and a retainer ring at the top of the housing around the neck portion to retain, seal and energize the insulation and the one or more seals.

In yet another broad aspect, the invention provides a method for providing a power connection from a source of current located at a wellhead to a downhole electrical device, wherein the wellhead includes one or more pressure-containing wellhead body members forming a vertical wellbore extending there through, the one or more wellhead body members being operative to support in a vertically stacked relationship in the vertical wellbore, a pair of tubing hangers, each tubing hanger being operative to suspend therefrom a tubing string such that the tubing strings are concentrically spaced from each other. The method includes:

i) providing a conduit in the one or more wellhead body members for access to the vertical bore proximate a first of said tubing hangers suspending a first of said tubing strings;

ii) connecting the source of current at a first connection through the conduit in a sealed and electrically isolated manner to the first tubing string, such that the one or more wellhead members are electrically isolated from the first tubing string; and iii) connecting the source of current at a second connection to the one or more wellhead body members at a location proximate the second of the tubing hangers suspending a second of said tubing strings so as to provide a ground connection to the second tubing string.

It should be understood that the terms "electrical connection" or "electrically connected" as used herein and in the claims is meant to cover both a direct or an indirect electrical connection between the identified members. Thus, for example when it is stated that an electrical connection is provided from the hot electrical connection to the conducting tubing string, the hot electrical connection may make a direct connection to the conducting tubing string, or the connection may be made indirectly through, for example, the conducting portion of the isolated tubing hanger.

It should also be understood that the terms "conductive" or "conducting" when used as adjectives herein and in the claims means that the material for the part modified by these terms is made of an electrically conducting material. Similarly, the terms "grounding" or "grounded" when used as adjectives herein and in the claims means that the material for the part modified by these terms is made of an electrically conductive material.

BRIEF DESCRIPTION OF THE DRAWINGS

FIGS. 5-10 provide six views of a second embodiment of the method and apparatus of this invention, using a rod and clamp assembly to make the electrical connection, in which:

FIG. 5 is a perspective view of the upper tubing head and the electrical feed through spool or clamp head, with the electrical connection being provided in the electrical feed through spool;

FIG. 6 is a top view of the electrical feed through spool and tubing head for the isolated tubing hanger;

FIG. 7 is a side section view of the electrical feed through spool and tubing head taken along line 7-7 of FIG. 6;

FIG. 8 is a side sectional view taken along line 8-8 of FIG. 6;

FIG. 9 is a side view of the electrical feed through spool and tubing head; and FIG. 10 is a top sectional view taken along line 10-10 of FIG. 9.

FIGS. 11-22 show a third embodiment of the invention using the rod and clamp connection similar to the second embodiment, but including more detail, and an alternate embodiment of the isolated tubing hanger, in which:

FIG. 11 is a side view, partially in section, showing the multiple wellhead body members, from top down including a tubing hanger adapter, electrical feed through spool, tubing head for the isolated tubing hanger, and grounding or neutral connection tubing head;

FIG. 12 is a side view of the electrical feed through spool for the hot electrical connection;

FIG. 13 is a top view of the electrical feed through spool showing the electrical clamp assembly in the vertical bore;

FIG. 14 is a side sectional view of the electrical feed through spool taken along line 14-14 of FIG. 13, showing the conductive rod, electrical clamp assembly and the electrical isolation assembly;

FIG. 15 is a perspective view of the electrical feed through spool showing the parts in exploded detail;

FIG. 16 is a perspective view of the electrical clamp assembly;

FIG. 17 is a side sectional view of the isolated tubing hanger, showing the conducting neck extension electrically isolated from the housing;

FIG. 18 is a perspective view of the isolated tubing hanger, showing the parts in exploded detail;

FIG. 19 is a perspective view of the grounding or neutral connection tubing head;

FIG. 20 is a side view, partially in section, of the grounding tubing head showing the profile for the neutral connection or grounding tubing hanger;

FIG. 21 is a side sectional view of the grounding tubing hanger; and

FIG. 22 is a side view, partially in section, of the neutral rod connection assembly.

DESCRIPTION OF THE PREFERRED EMBODIMENTS

Figure 1:
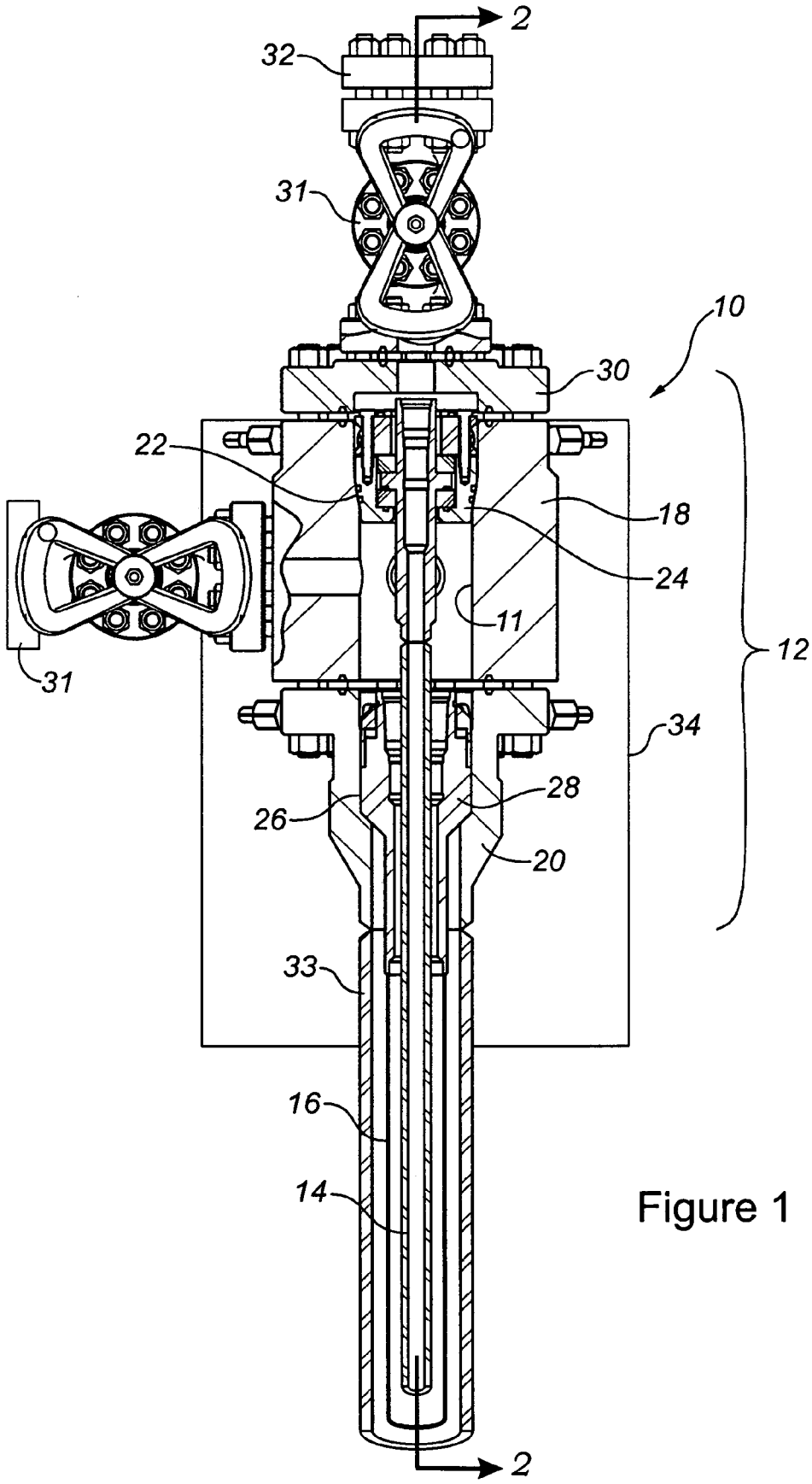
FIG. 1 shows a side view, partially in section, of one embodiment of the method and apparatus of this invention, using reciprocating horizontal rams to make the electrical connection in an upper tubing head, and using a grounding or neutral connection assembly therebelow, including a grounding or neutral tubing head, to make a ground connection.
Figure 2:
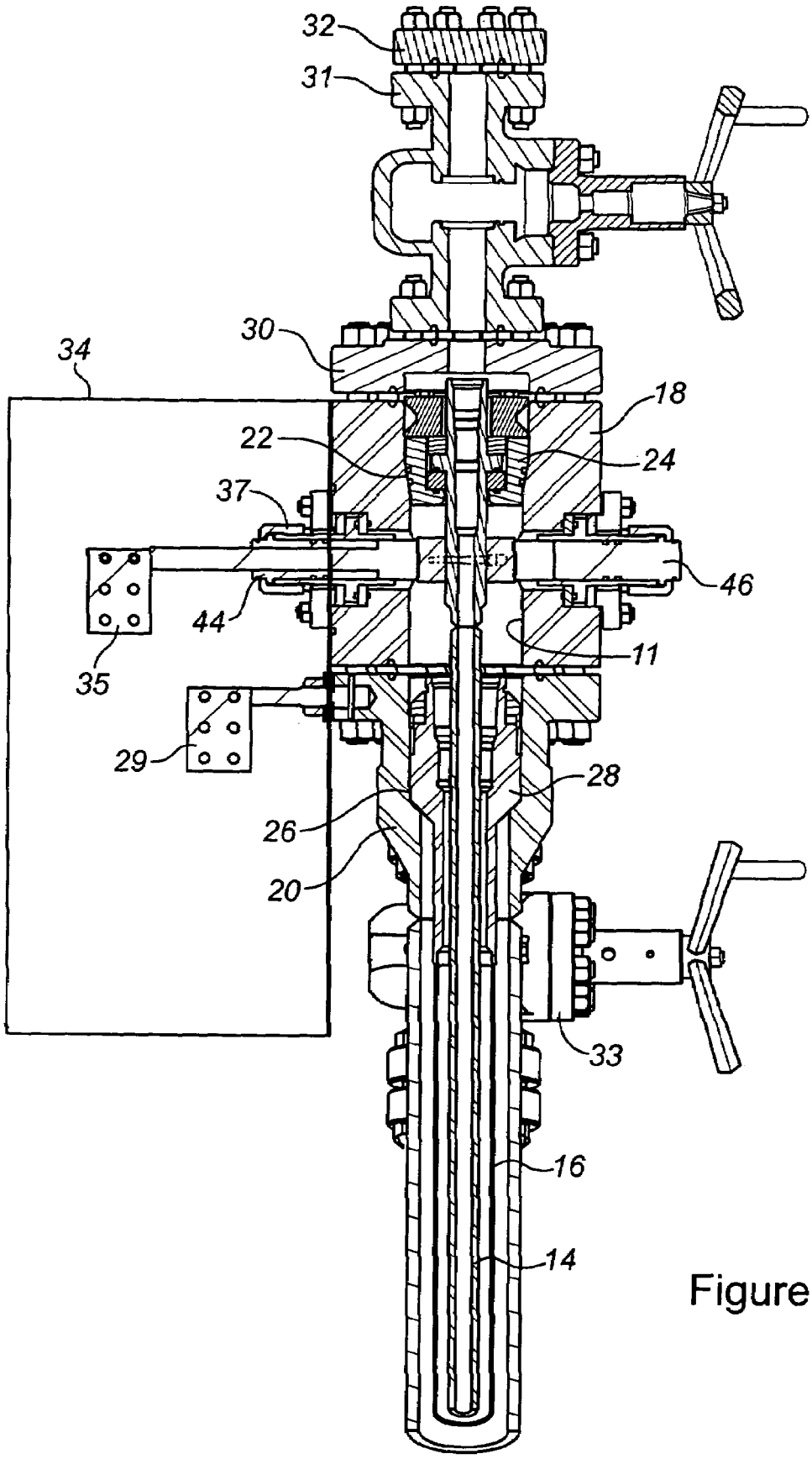
FIG. 2 is a side sectional view taken along line 2-2 of FIG. 1.
Figure 3:
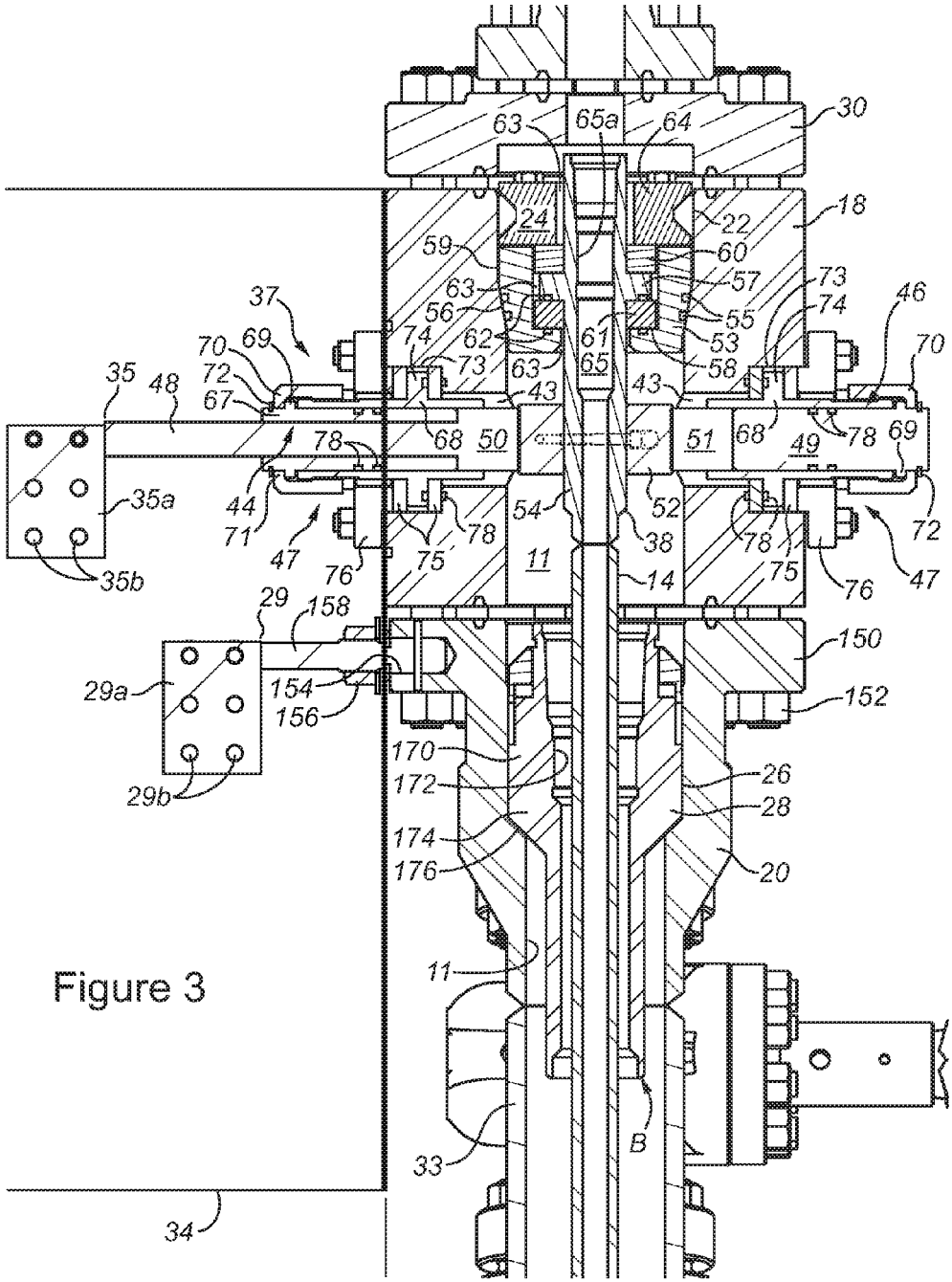
FIGS. 3 and 4 are partial side sectional views of FIGS. 1 and 2 respectively, showing a conducting ring fixed on the lower portion of the electrically isolated tubing hanger in order to make electrical contact to the conducting tubing string, and thus to make the electrical connection to the conducting ram assembly.
Figure 4:
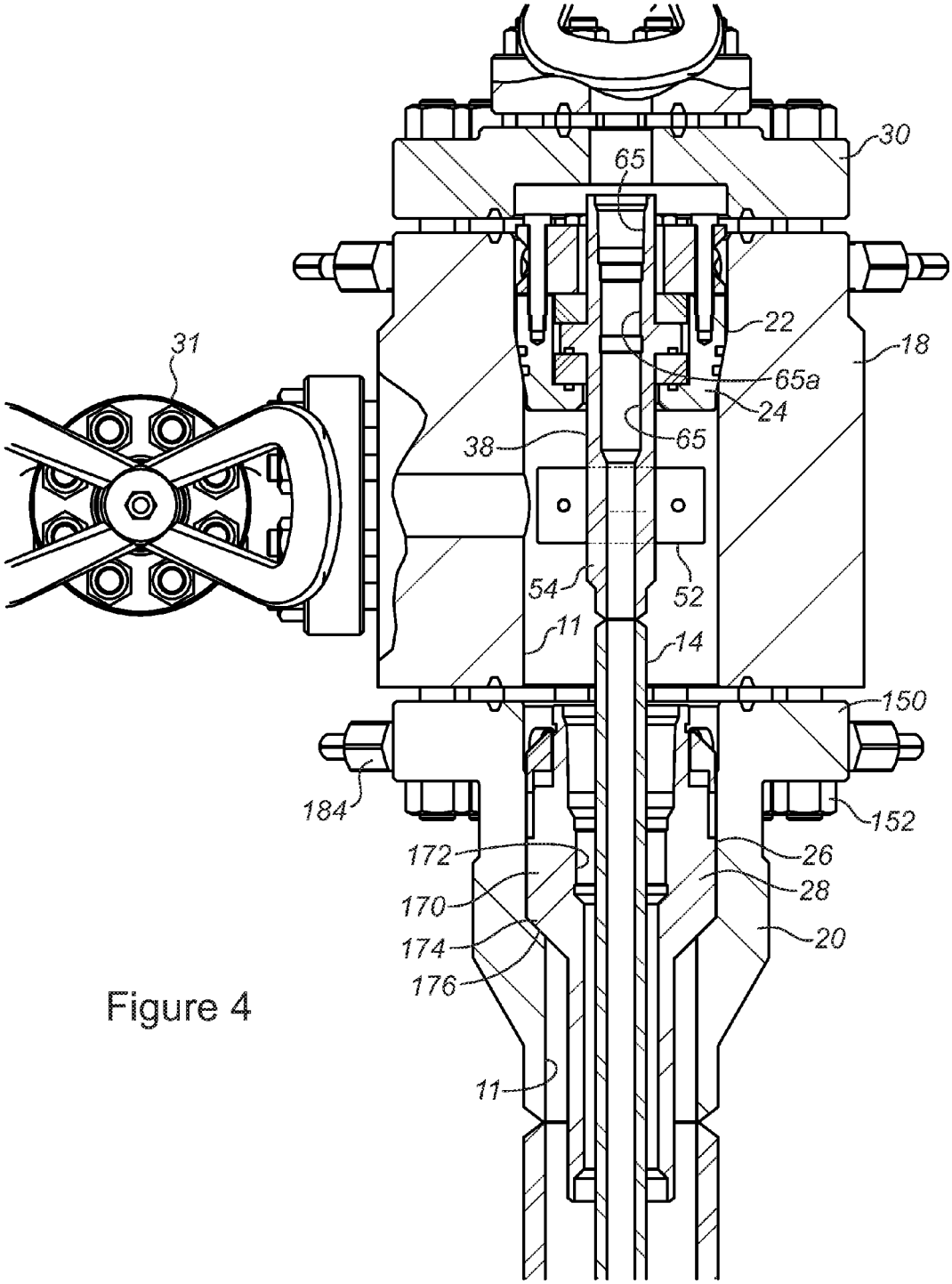
Figure 5:
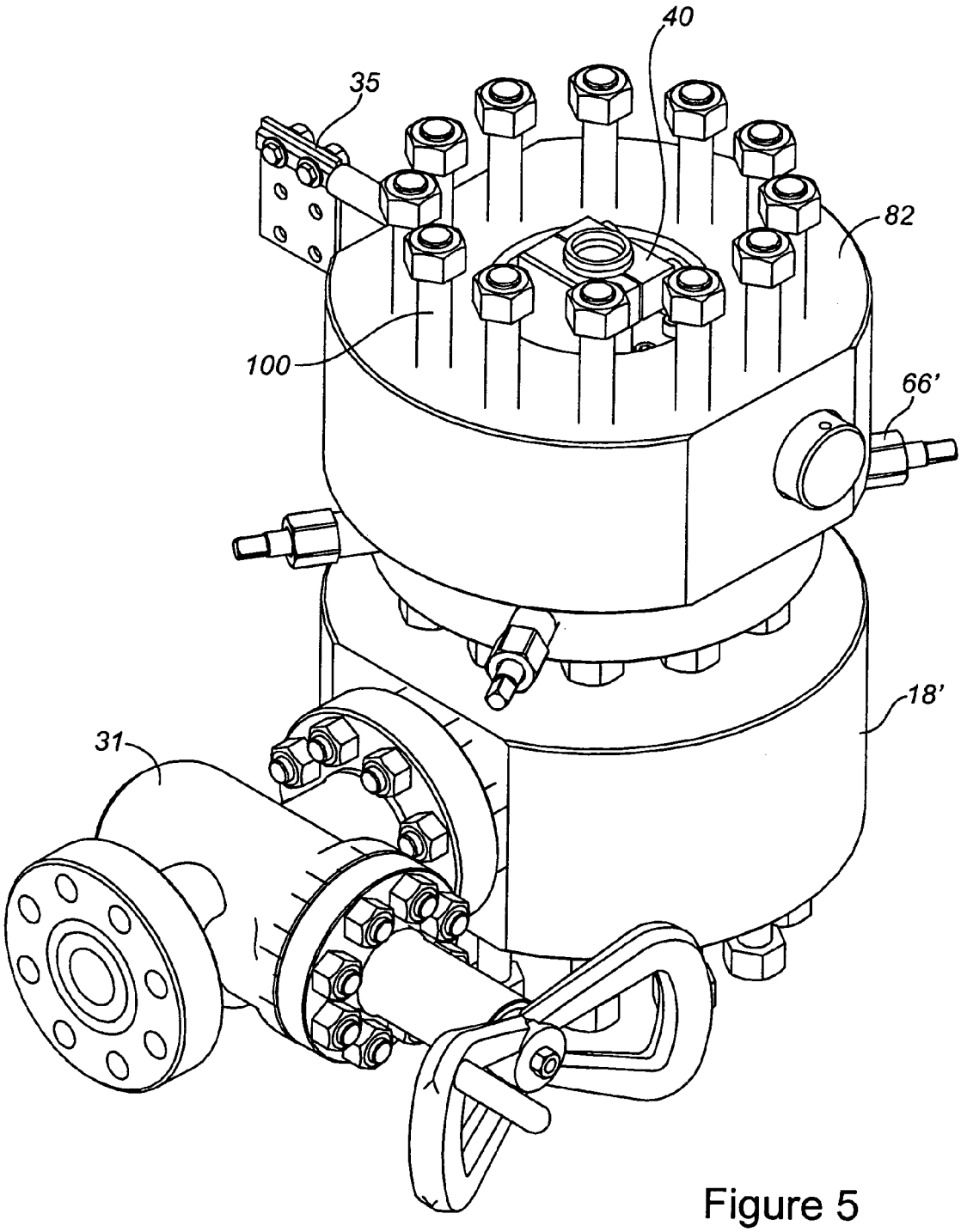
Figure 6:
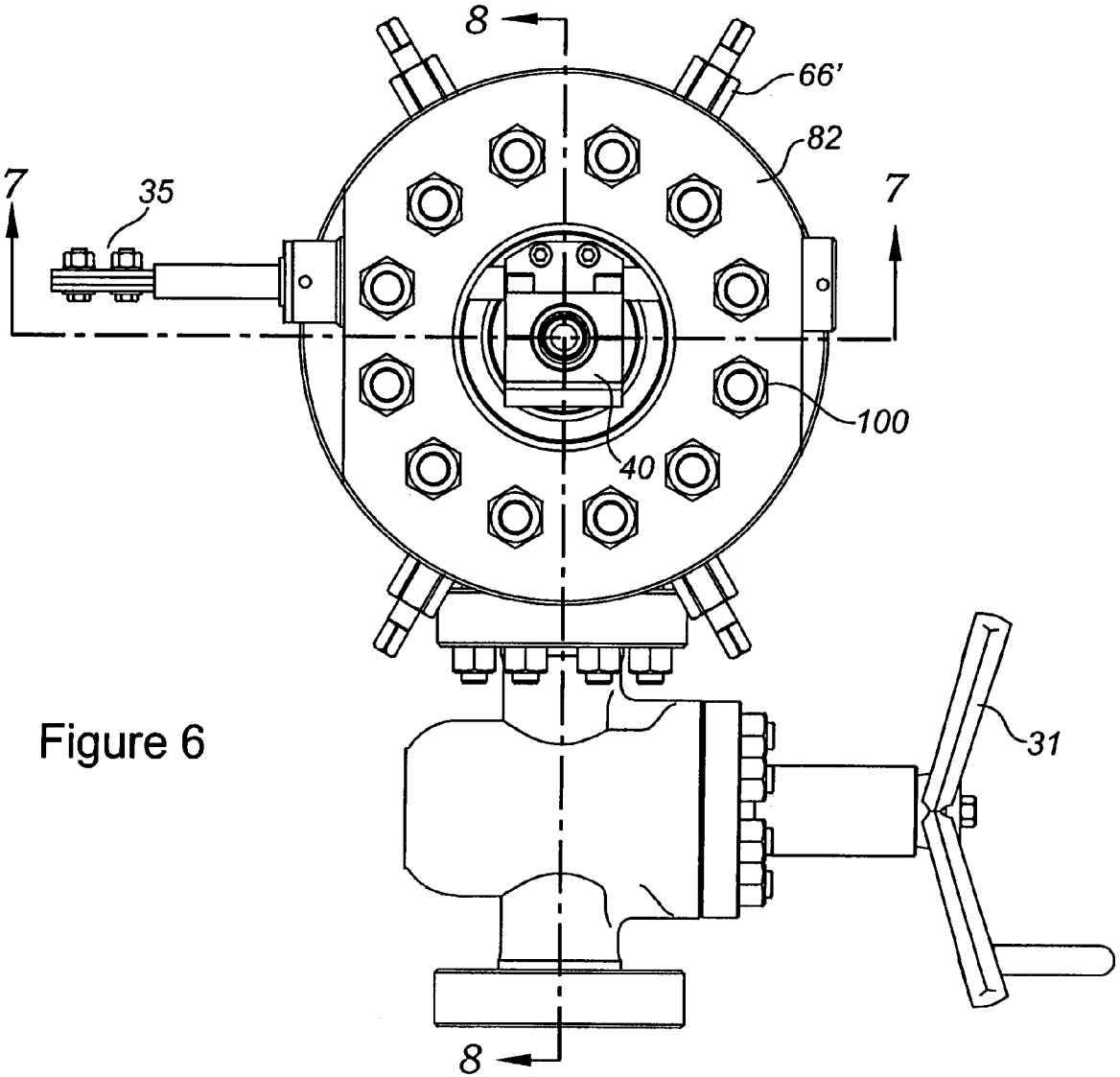
Figure 7:
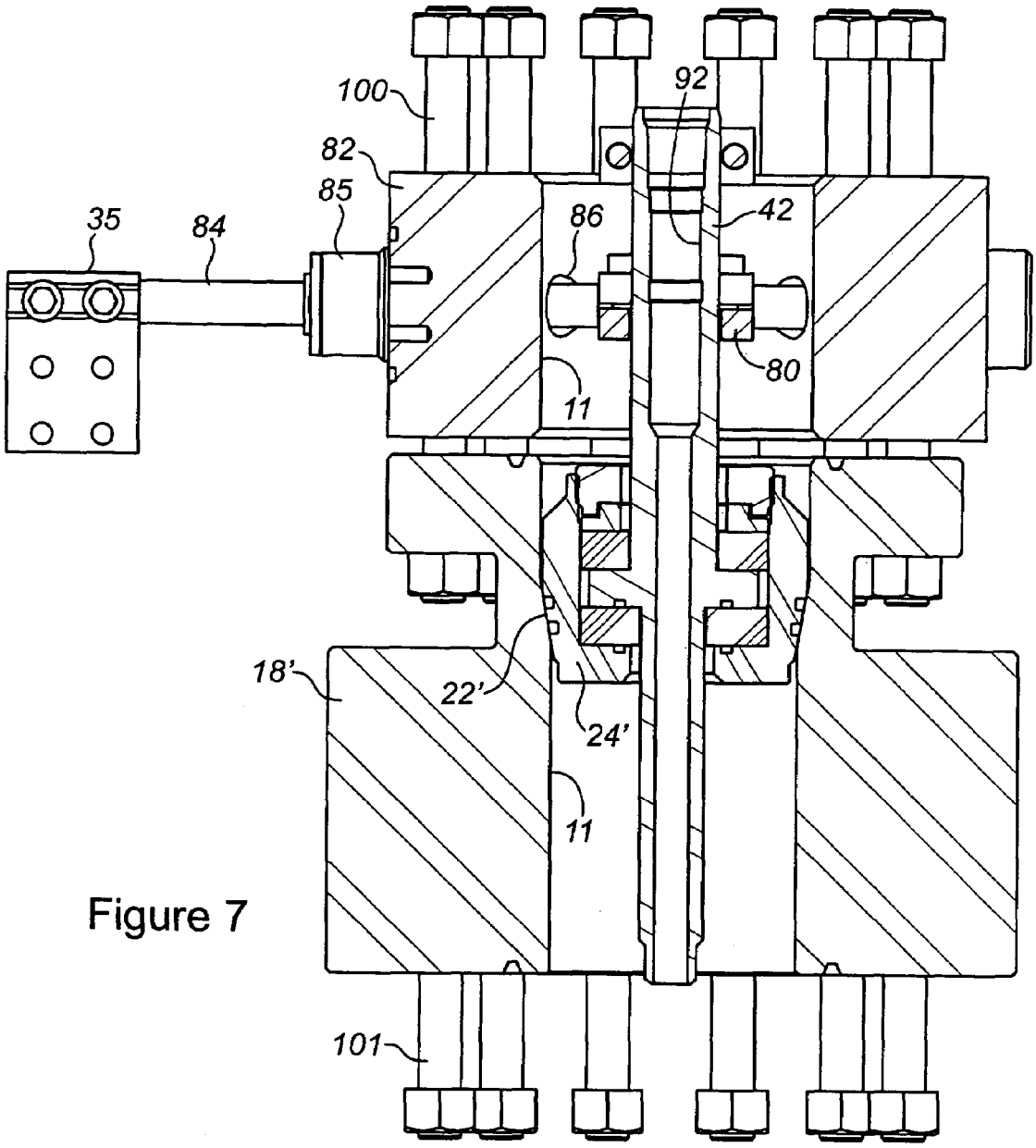

The present invention provides both a method and apparatus for providing electrical connection at a wellhead for a downhole electrical device such as a heater or a pump. The invention has utility in providing the electrical connection through to tubular conductors (generally concentric tubing strings), which in turn are electrically connected to the downhole electrical device. Four embodiments of the present invention are shown in the Figures, with like members being labeled with the same reference numerals. Once an element has been introduced for the first embodiment, it is denoted with a prime or double prime after the reference numeral for the second, third or fourth embodiments if it is slightly modified or if is included in a modified part of that embodiment.

In general, the wellhead power connection assembly 10 of the present invention is shown in the Figures to include one or more wellhead body members 12 (multiple wellhead body members are shown in the Figures, although it is possible to combine these as one within the invention), operative to cap a wellbore which has been drilled into an oil formation and contains pressure in a vertical wellbore 11, which extends through each of the body members 12 and is generally vertically aligned. Thus, each of the one or more wellhead body members is formed from pressure containing metal, with all connections (such as O-ring seals between body members) being pressure-containing. Two concentric tubing strings (one of which could be the casing, but referred to herein as tubings or tubing strings) formed of electrically conductive material are provided, which are shown in the Figures as an inner conducting tubing string 14 and an outer grounding tubing string 16. The tubing strings 14, 16, along with an electrical downhole apparatus (not shown) are run into the wellbore. The tubing 14, 16 are suspended in concentrically stacked tubing heads 18, 20 in the wellhead assembly 10, and are used to conduct electricity to the downhole electrical device. The uppermost tubing head 18 forms a tubing hanger profile 22 operative to support and seal to an isolated tubing hanger 24. The conducting tubing 14 is suspended, for example by welding, from the lower end of the tubing hanger 24, to provide power to the downhole electrical device (not shown). The lower tubing head 20 (termed grounding or neutral tubing head) forms a tubing hanger profile 26 operative to support and seal to a grounding tubing hanger 28, which in turn suspends the grounding tubing 16 from its lower end, for example by welding. A ground or neutral connection assembly 29, consisting of a grounding plate 29*a* and nut and bolt connectors 29*b*, provides a ground connection from the current source for the grounding tubing head 20 proximate the grounding tubing hanger 26. The circuit is completed through the downhole electrical device.

The wellhead assembly 10 is shown to include a tubing head adapter 30 as a transition body member to the conventional wellhead equipment located thereabove (shown as a conventional gate valve 31 and a blind flange 32 in the Figures). The tubing head adapter 30 also functions to form extra spacing in its vertical bore 11 above the isolated tubing hanger 24, to assist in electrical isolation. At its lower end the grounding tubing head 20 connects to convention wellhead equipment such as surface casing or valve equipment, shown generally as 33 in the Figures. Additional conventional gate valve 31 is shown with the tubing head 18 in order to close off the vertical bore 11.

An electrical junction box 34 is mounted to or alongside the body member(s) 12. A power source (not shown) provides a source of current with a first connection to a hot electrical connection assembly 35, including a connection plate 35*a* and nut and bolt connectors 35*b*, proximate the tubing head 18 and a second connection to the ground or neutral connection assembly 29 proximate the grounding or neutral tubing head 20. The ground connection assembly 29 includes a connection plate 29*a* and nut and bolt connectors 29*b*).

The present invention provides methods and apparatus for providing an electrical connection through the wellhead to provide electricity to the downhole electrical device. In its preferred embodiments described herein, the unique design of the electrical connection allows for mechanical disengagement of the electrical connection while the wellhead and wellbore are under pressure.

In general, components of the present invention provide seals or are made of materials capable of providing high pressure, high voltage, and high current isolation at elevated temperatures, particularly for operation in conditions needed for electrical heating of a heavy oil reservoir. To limit eddy currents, certain components of the assembly 10 may be made from non-ferromagnetic materials. Electrically isolating materials used in the isolated tubing hanger 24 and the electrical isolation assembly 47 associated therewith, may be made from known electrically insulating materials, for example Teflon® (where not load bearing), and PEEK (polyetherethylketone) when load bearing. Alternate insulating materials such as NEMA Grade 7 through Grade 11 materials and others may be used, as known in the art.

In the first and fourth embodiments shown in the FIGS. 1-4, and FIG. 23 and described hereinbelow, the electrical connection is made through a ram assembly 37, to a downwardly extending conducting neck extension 38 of the isolated tubing hanger 24 (i.e., located below the tubing hanger profile 22). In the second and third embodiments (FIGS. 5-10 and 11-22), electrical connection is made through a rod and clamp connection assembly 40, to an upwardly extending conducting neck extension 42 (or 42") of the isolated tubing hanger 24' (or 24") (i.e., located above the tubing hanger profile 22). The ground or neutral connection assembly and associated grounding or neutral tubing head equipment, being common to all four embodiments is described in detail only in association with the third embodiment. In all of the embodiments shown, the electrical connection is made to a conducting portion of the isolated tubing hanger. However, it should be appreciated that the electrical connection may be made directly to the conducting tubing 14, within the scope of the present invention.

First Embodiment

Ram Connection, FIGS. 1-4

The ram assembly 37 is sealed and electrically isolated in a horizontal conduit 43 in the tubing head 18. The conduit 43 is located to provide access through the tubing head 18 to the vertical bore 11 at a point to provide electrical connection either directly to the conducting tubing 14, or more preferably, to a conductive portion of the isolated tubing hanger 24, such as the conducting neck extension 38 of the tubing hanger 24, as shown in the FIGS. The ram assembly 37 is shown to preferably include two ram assemblies, a conducting ram assembly 44 and a supporting ram assembly 46, located in the tubing head 18. The interface between the ram assemblies 44, 46 and the tubing head 18 is pressure sealed and electrically isolated through an electrical isolation assembly 47. The conducting actuation rod 48 and conducting ram 50 of the conducting ram assembly 44 are formed of an electrically conductive material such as copper, with one end of the rod 48 being connected to a source of current through the hot electrical connection assembly 35. The supporting ram assembly likewise includes a support ram 51 connected to a support actuation rod 49. The rams 50, 51 in each ram assembly 44, 46 move horizontally in and out of the vertical Wellhead bore 11 of the tubing head 18. When fully protruding into the vertical wellhead bore 11 (see FIG. 3) the rams 50, 51 preferably contact a conducting ring 52 fixed to the conducting neck extension 38 of the electrically isolated tubing hanger 24, which in turn is in direct electrical contact with the conducting tubing 14 (welded). The ring 52 is formed of an electrically conductive material such as copper, and may be bolted to the neck extension 38. The ring 52 increases the diameter of electrical contact area and reduces the required travel of the rams 50, 51. The heads of the rams 50, 51 are preferably concave in shape to maximize the electrical surface area for contact with the ring 52. The conducting ram assembly 44 conducts electricity into the hanger 24 and tubing 14 (through the conductive rod 48 and the ram 50 connected to the rod 48), while the supporting ram assembly 46 stabilizes the neck extension 42 of the tubing hanger 24. When the rams 50, 51 are fully retracted from the wellbore 11, the electrical connection is broken and full bore access from the top of the wellhead is achieved. The rams 50, 51 can thus be operated while the wellhead is under pressure. There is no need to remove electrical equipment to gain access to the hanger 24 or the wellbore 11, the electrical connection can simply be broken with this ram assembly design.

The isolated tubing hanger 24 is formed with an outer, generally cylindrical housing 53 (which remains electrically isolated), and an inner, generally cylindrical landing coupling 54 which provides electrical contact between the rams 50 and the conducting tubing 14. O-ring seals 55 on the external circumference of the outer housing 53 seal the hanger 24 within a circumferential seat or shoulder 56 in the profile 22 for the isolated tubing hanger 24. The landing coupling 54 includes a widened diameter, circumferential landing shoulder 57 which seats on an inwardly extending circumferential landing seat 58 in the central bore 59 of the tubing hanger 24. The downwardly extending neck extension 38 is formed at the lower end of the landing coupling 54 and extends below the profile 22 for the tubing hanger 24. The conducting tubing 14 is suspended from the lower end of the neck extension 38, for example by welding, with the conducting ring 52 being bolted to the neck extension 38 at a location to align with the rams 50, 51. The landing coupling 54 is electrically isolated from the outer housing 53 by a pair of upper and lower electrical insulation plates 60, 61 made of an electrical insulation material which is load bearing such as PEEK, located above and below the landing shoulder 57 of the coupling 54. O-ring seals 62 above and below the lower insulation plate 61 seal the landing coupling 54 with the central bore 59 of the hanger housing 53. Spacing 63 or insulation are also provided between the housing 53 and the landing coupling 54 (see FIGS. 3 and 4). The hanger parts are energized and retained by a retainer ring 64 which is bolted into the top of the housing 53 (see FIG. 4). The landing coupling 54 has a threaded portion 65*a* at its central bore 65 for a back pressure valve (not shown), which may be a one way or two way valve, as appropriate for the particular application. Sealed hanger lockscrews 66 protrude through the isolated tubing hanger 18 to the retainer ring 64 in order to lock the isolated tubing hanger 24 against upward movement.

The electrical isolation assembly 47 for the ram assemblies 44, 46 achieves electrical isolation of the isolation tubing head 18, while sealing the assemblies 44, 46 and allowing for horizontal reciprocating movement of the rams 50, 51. On the conducting ram side, the assembly 47 includes an electrically conductive actuation sleeve 67, fixed for example by welding, around the conducting actuation rod 48 and extending out of the tubing head 18. The actuation sleeve 67 is surrounded by an electrically conductive, static ram housing 68. An outer ring 69 fixed to or integral with the end of the actuation sleeve 67 opposite the ram 50, provides a widened diameter portion of the actuation sleeve 67. An actuation nut 70 is threaded onto the end of the housing 68 protruding from the tubing head 18. An inwardly extending lip 71 of the actuation nut 70 is positioned to contact the outer ring 69 of the actuation sleeve 67, such that rotation of the nut 70 pushes the sleeve 67 and thus the ram 50 into the wellbore 11 against the conducting ring 52. A ring 72 fixed to the end of the actuation sleeve 67 provides a shoulder for contact with the lip 71 of the actuation nut 70 such that on disengaging of the threads on the actuation nut 70, the actuation sleeve 67 and thus the ram 50 is retracted from the wellbore 11 to break the electrical contact. The horizontal conduit 43 includes a widened portion forming a circumferential seal pocket 73 at the outer wall of the tubing head 18. An outwardly extending sealing shoulder 74 fixed to or integral with the ram housing 68 seals in this seal pocket 73. Isolation sleeves 75, formed of an electrically isolating material of sufficient strength to handle the actuation and pressure loads (for example PEEK) are located on either side of the sealing shoulder 74 in the seal pocket 73. A retainer ring 76 is bolted to the outer wall of the tubing head 18 to retain and seal the ram assembly 44 within the conduit 43. O-ring seals 78 located around the inner of the isolation sleeves 75 provide a seal between the tubing head 18 and the ram housing 68. Similarly, O-ring seals 78 located between the actuation sleeve 67 and the ram housing 68 seal the actuation sleeve 67 within the housing 68. Spacing around the ram housing 68 and the wall of the horizontal bore 43 provide electrical isolation. Certain parts of the electrical isolation assembly, including sleeve 67, housing 68, nut 70 and rings 69 and 72 are preferably made of non-magnetic materials. Similar parts are included on the support ram side of the electrical isolation assembly to electrically isolate, seal and actuate the support ram 51 and support rod 49 in the conduit 43, except that the actuation sleeve and support actuation rod are combined in a single part labeled as 49.

The ground connection and grounding tubing head equipment for this embodiment is as described below for the third embodiment (sometimes termed neutral connection and neutral connection tubing head, but otherwise the same).

Second Embodiment

Rod and Clamp Connection, FIGS. 5-10

The rod and clamp connection assembly 40 provides a hot connection through to the conducting tubing 14 as for the first embodiment, but is preferably housed in a separate electric feed through spool 82 (also termed clamp head) connected above a tubing head 18'. The tubing head 18' is similar in function to tubing head 18 of the first embodiment, in providing a tubing hanger profile 22' for suspending an isolated tubing hanger 24'. However, whereas the first embodiment has provision in the tubing head 18 for the ram assembly 37 to make the electrical connection, this function is now provided by the electric feed through spool 82 of the second embodiment. As well, the isolated tubing hanger 24' differs from that in the first embodiment, by providing an upwardly extending conducting neck extension 42, for connection to the rod and clamp connection assembly 40. Other aspects of these parts 18' and 24' which are shared with the first embodiment, are commonly labeled in FIGS. 5-10, and are not further described herein.

Figure 8:
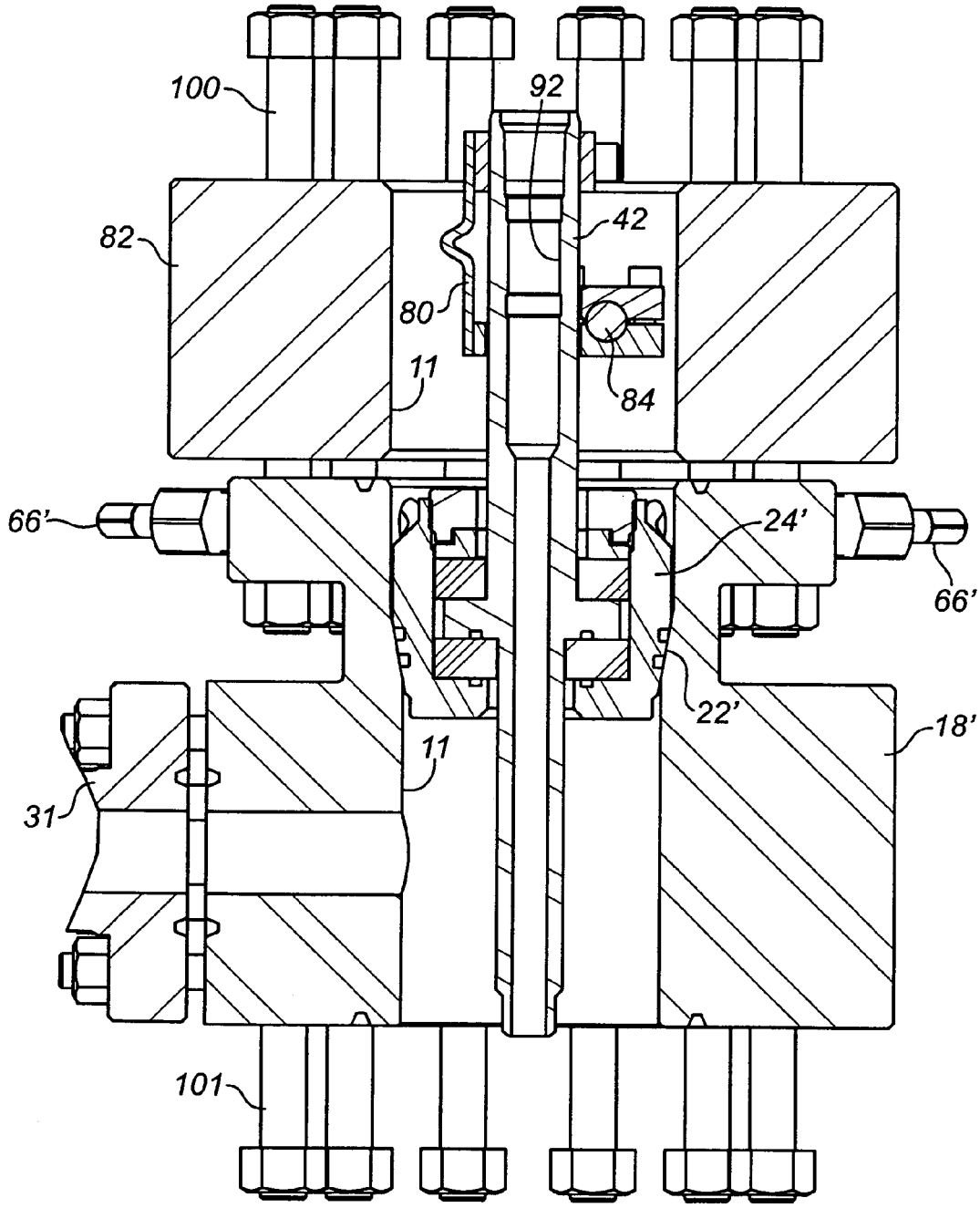
Figure 9:
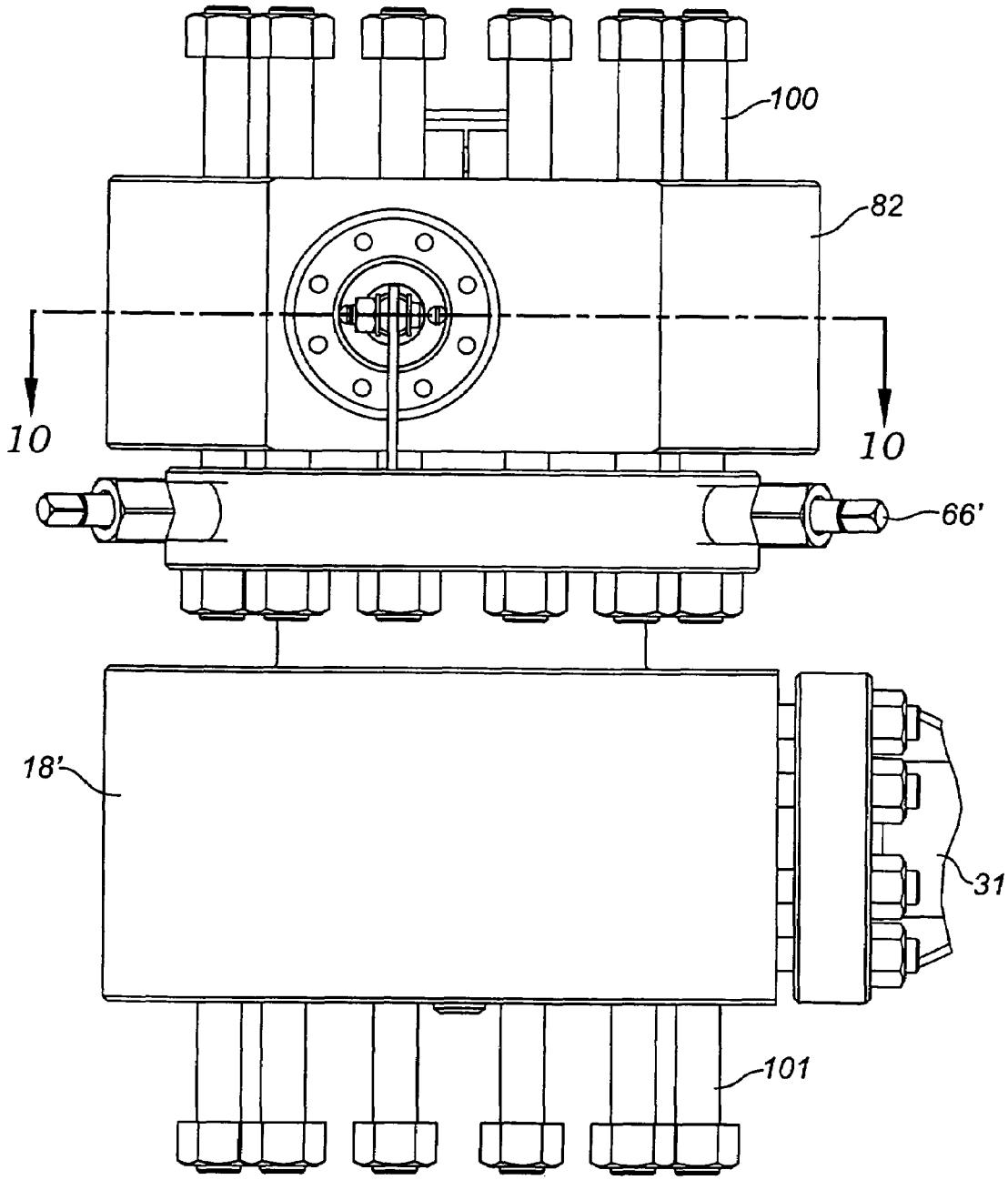
Figure 10:
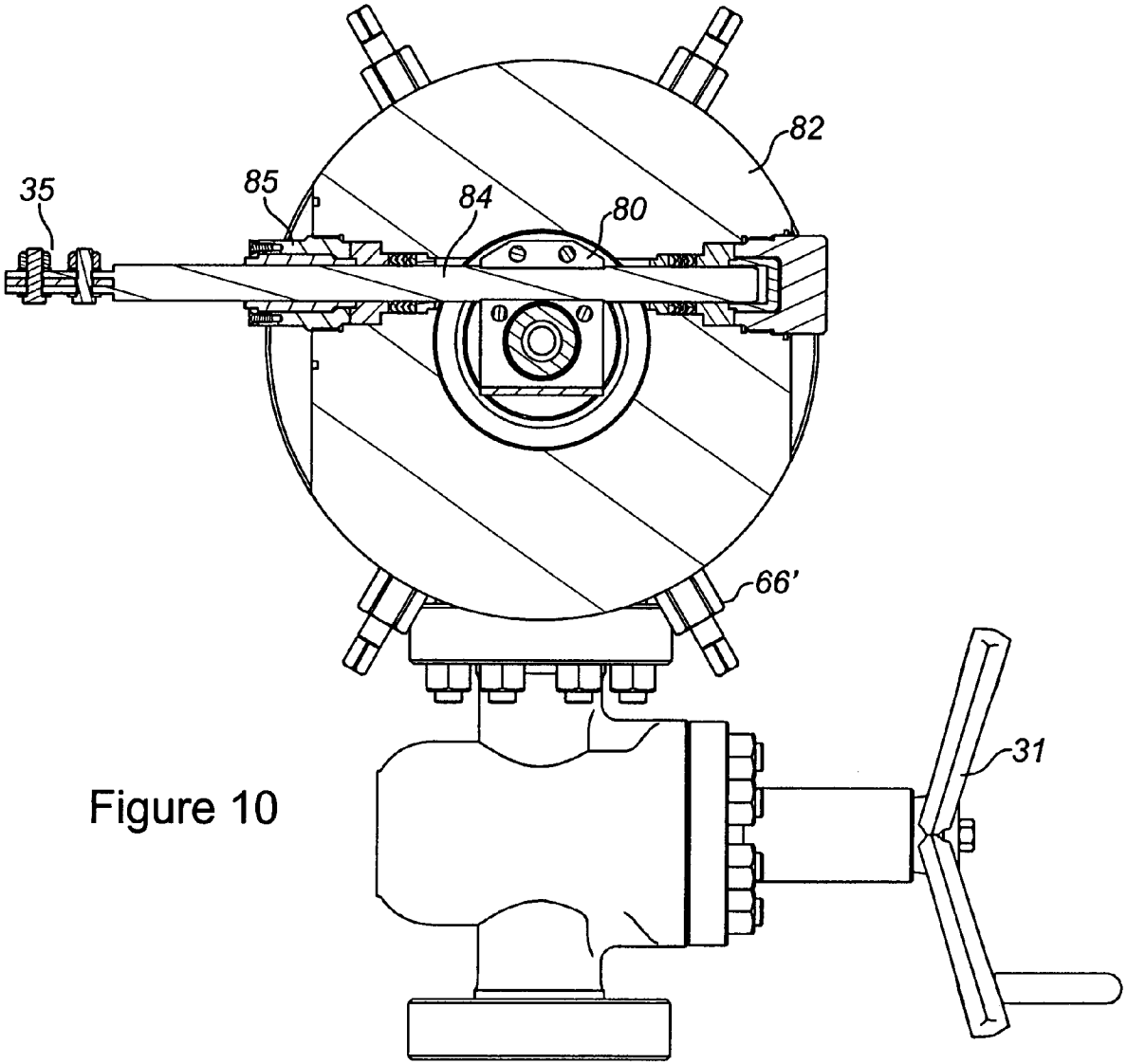

The rod and clamp assembly 40 provides a clamp assembly 80 inside the vertical bore 11 of the electrical feed through spool 82. A horizontal conductive rod 84 protrudes into the vertical bore 11 of the electrical feed through spool 82 and is clamped by the clamp assembly 80. The conductive rod 84 is pressure sealed and electrically isolated at each end by an electrical isolation assembly 85 within a horizontal conduit 86 which extends through the electrical feed through spool 82 to the vertical bore 11, more fully described below for the third embodiment. It is possible for the conductive rod 84 to end at the clamp assembly 80, but it is more preferably pressure balanced by extending across the vertical bore 11 with pressure sealing around both ends by the isolation assembly 85. The conductive rod 84 protrudes out one side of the electrical feed through spool 82 for connection to the hot electrical connection assembly 35. The clamp assembly 80 is mechanically attached (clamped) to the conductive rod 84 protruding into the vertical bore 11 of the electrical feed through spool 82. When in place, the clamp assembly 80 is positioned above the electrically isolated tubing hanger 24' around the tubing hanger neck extension 42 which extends into the electrical feed through spool 82 (FIG. 8). The clamp assembly 80 is pre-assembled onto the conductive rod 84, such that the tubing hanger neck extension 42 will be parallel to the vertical bore 11 of the electrical feed through spool 82. The electrical feed through spool 82 can then be lowered over the tubing hanger neck extension 42, with the neck extension 42 protruding through the tubing hanger neck extension bore 88 of the clamp assembly 80. The electrical feed through spool 82 can then be bolted to the tubing head 18 and the clamp assembly 80 can be tightened onto the tubing hanger neck extension 42. The clamp assembly 80, when in place in the wellhead, provides a mechanical and electrical connection between the conductive rod 84 and the isolated tubing hanger 24 and conducting tubing 14. The clamp assembly 80 is made of an electrically conductive material such as copper to reduce resistivity in the electrical circuit.

The tubing hanger neck extension 42 preferably contains a back pressure valve thread and profile 92. Pressure can then be contained inside the conducting tubing 14 when a back pressure valve (not shown) is installed in the tubing hanger neck extension 42. This allows the electrical feed through spool 82 and clamp assembly 80 to be installed or removed while the conducting tubing 14 is under pressure.

Third Embodiment

Rod and Clamp Connection, FIGS. 11-22

A second embodiment of the clamp connection is shown in FIGS. 11-22. This embodiment shows an alternate embodiment of an isolated tubing hanger 24", and greater details for the electrical isolation assembly 85 (common to second and third embodiments) and the ground or neutral connection (common to all embodiments). Like parts are labeled with the same numbers for ease of comparison.

Wellhead Body Members

Figure 11:
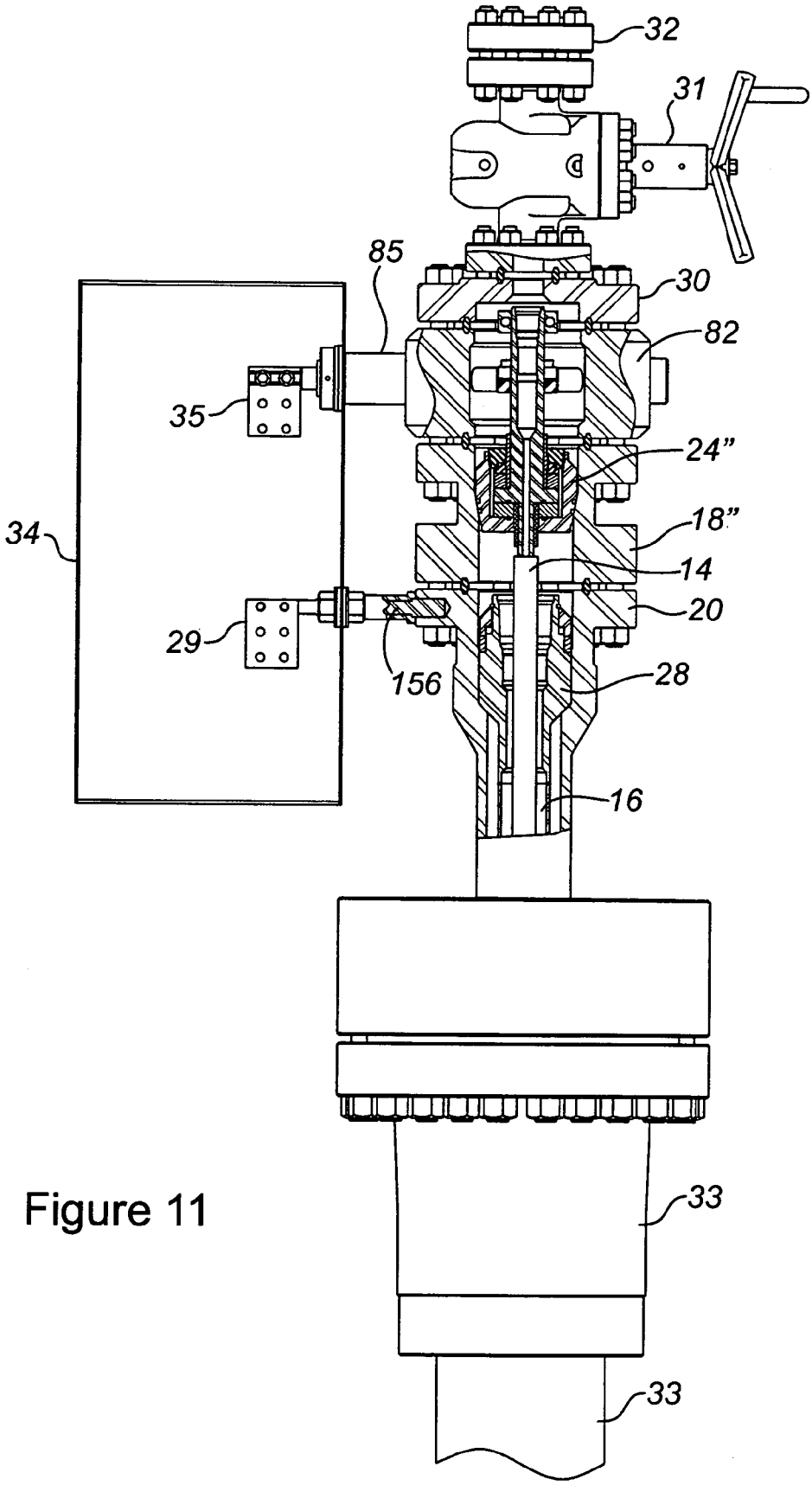
Figure 12:
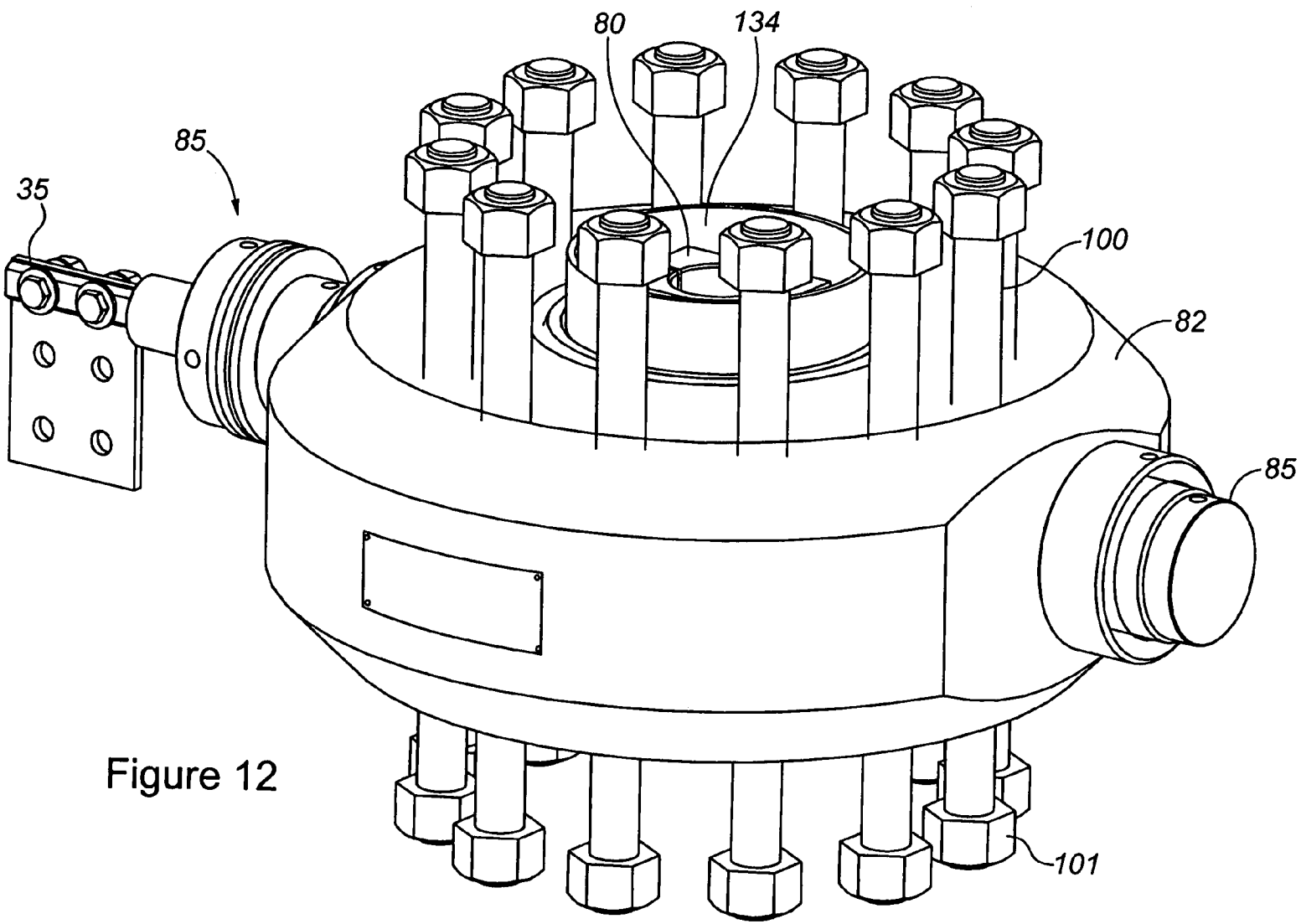
Figure 13:
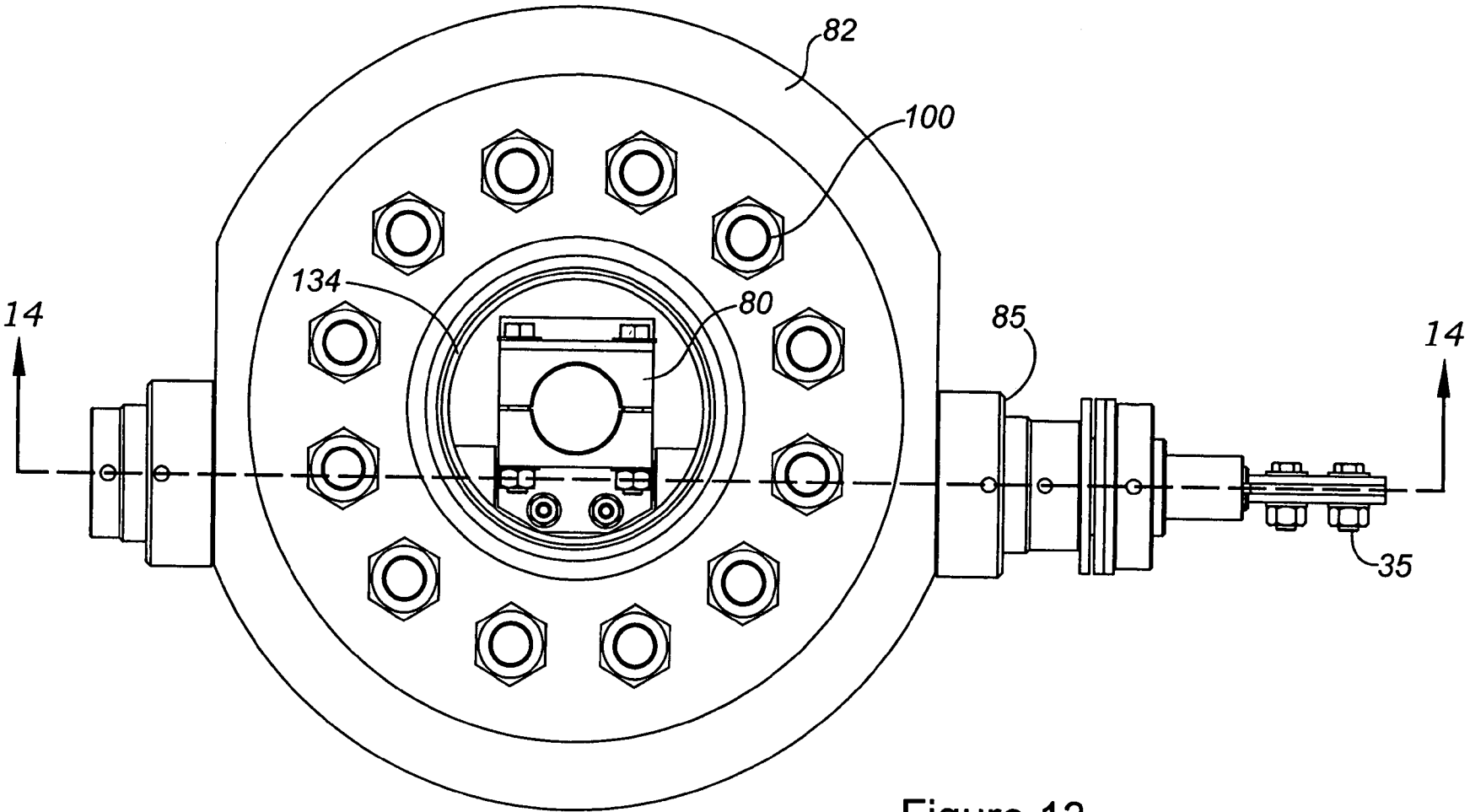
Figure 14:
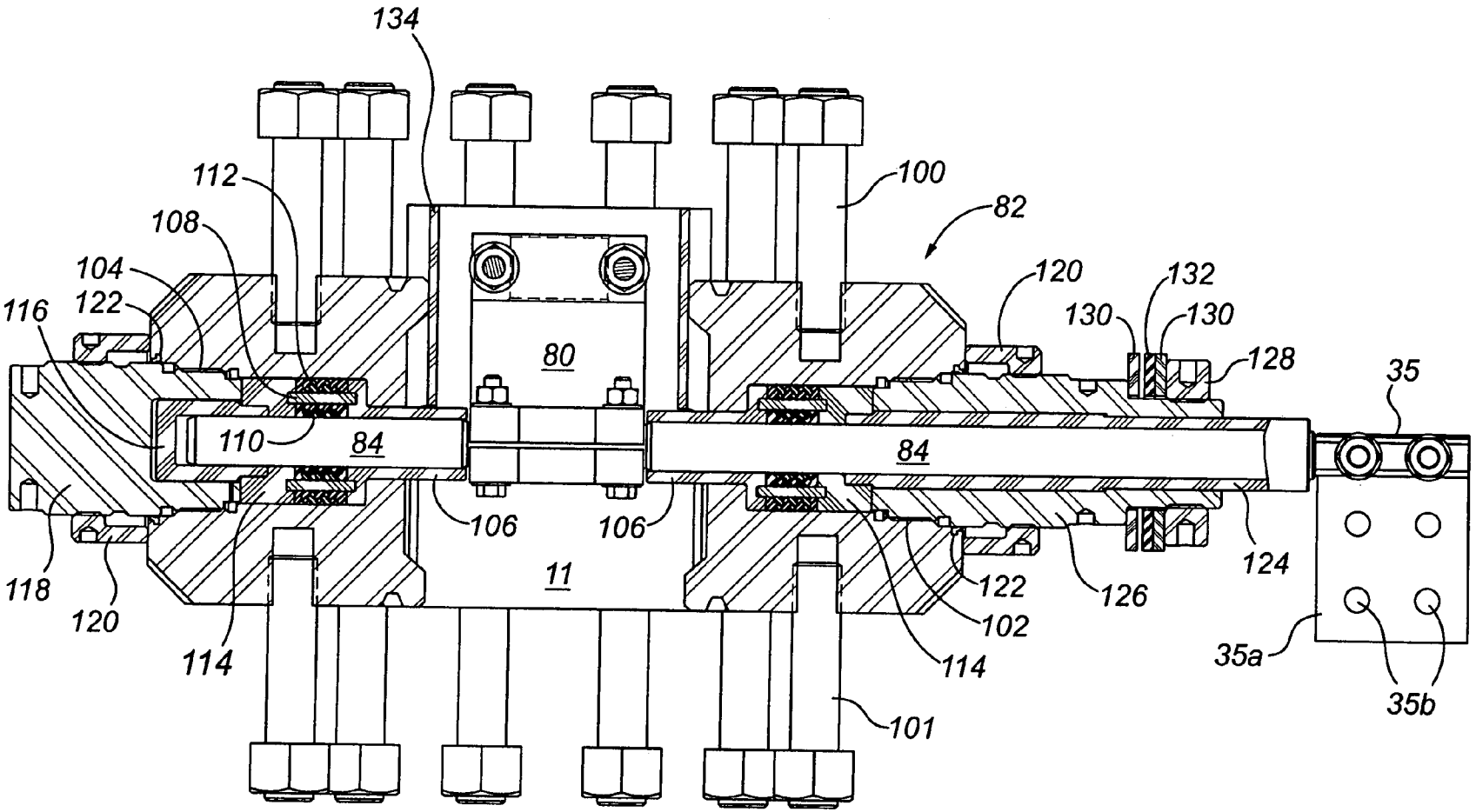
Figure 15:
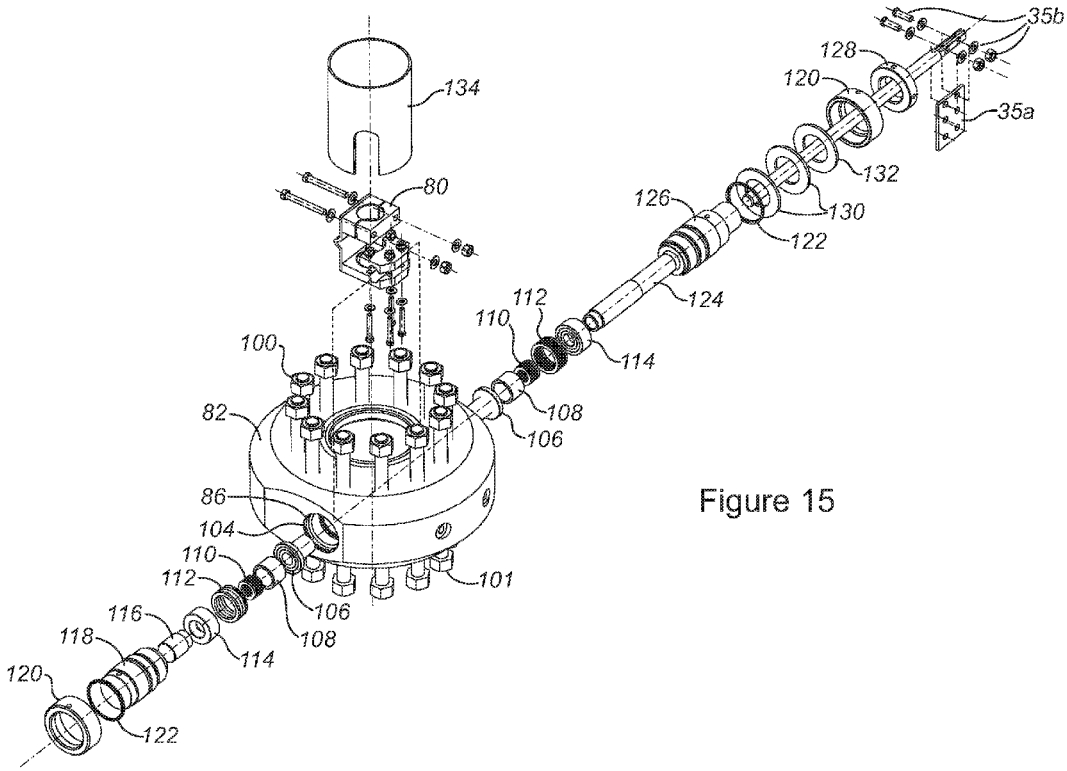

In FIG. 11, the multiple wellhead body members 12 are shown to include, from top down, a tubing head adaptor 30, an electrical feed through spool 82, a tubing head 18" and a neutral connection tubing head 20. The tubing head adaptor 30 is shown to connect to convention wellhead equipment located thereabove, such as the gate valve 31 and blind flange 32. The neutral connection tubing head 20 is shown connected to conventional surface casing and wellhead equipment 33. The wellhead body members 12 of this invention may be combined as one or more wellhead body members within the scope of this invention. In this particular embodiment, the provision of the electrical feed through spool 82 above the tubing head 18", with a back pressure valve being provided therein as described below, allows for ease in running the electrically isolated tubing hanger 24" and making the electrical connection while the wellhead is under pressure. The body member parts 82, 18", and 20 are shown as having studded connections top and bottom, although alternate connectors such as threaded or flanged, are possible. Each of these body members, when connected, forms a vertical wellbore 11 extending there through. The tubing head 18" forms a hanger profile 22 to land and seal the isolated tubing hanger 24", while the grounding tubing head 20 forms a hanger profile 26 for the grounding tubing hanger 28, such that the tubing hangers 24" and 28 are in a vertically stacked relationship to suspend respectively the conducting tubing 14 and the grounding tubing 16 in concentric relationship.

Hot Electrical Connection

The hot electrical connection is provided from the hot electrical connection assembly 35 through the electrical feed through spool 82. The vertical wellbore 11 extends through the spool 82 to provide a clamp bore for the clamp assembly 80. The spool 82 is shown with top and bottom studded connections 100, 101 to wellhead equipment located above and below, although alternate connectors may be used. The spool 82 is formed with a horizontal conduit 86 extending there through, which provides access to the vertical bore 11. An electrical conductive rod 84 is sealed through an electrical isolation assembly 85 into the horizontal conduit 86 bore between an electrical connection end 102 and a plug end 104 of the bore 86. The electrical connection end 102 provides for hot electrical connection to an electrical connection plate 35*a*, which is bolted by connectors 35*b* to the rod 84 for connection to a source of current at the hot connection assembly 35. The conductive rod 84 is connected to the electrical clamp assembly 80, which in located in the vertical bore 11 to provide for electrical connection between the conductive rod 84 and the electrically isolated tubing hanger 24". As shown in the Figures, the conductive rod 84 is preferably pressure balanced, so extends through the vertical bore 11 and is sealed in the horizontal conduit 86 of the spool 82 on both sides. Alternatively, the conductive rod 84 could end at the clamp assembly 80.

Electrical Isolation Assembly

In order to seal and electrically isolate the conductive rod 84 from the spool 82, the rod 84 is held within the horizontal conduit 86 by an electrical isolation assembly 85. This assembly includes, around the conductive rod 84 at the clamp assembly 80, a pair of pack off bushings 106 such as Teflon® sleeves, a pair of pack off gland inserts 108, formed of a PEEK material, a pair of inner and outer packing rings 110, 112, such as Teflon®, and a pair of packing glands 114, formed from a PEEK material. At the plug end 104 of the horizontal conduit 86, the rod 84 is held within an end cap 116, formed from example Teflon®. A packing gland retainer 118 is threaded at its inner end into the end of the horizontal conduit 86 to retain the packing and electrical isolation items 106, 108, 110, 112, and 114. The outside diameter of the packing gland retainer 118 is threaded to mount a lock nut 120, which prevents the packing gland retainer 118 from backing out of the spool 82. The lock nut 120 is preferably formed from a non-magnetic material limit eddy current heating. A wiper ring 122 around the packing gland retainer 118 keeps the thread free of debris while preventing pressure build up at the end of the rod 84.

At the electrical connection end 102 of the horizontal conduit 86, the rod 84 is held within a bushing 124, formed for example from Teflon®, which in turn is held within a packing gland retainer 126 (similar to 118) which is threaded at its inner end into the horizontal conduit 86. The packing gland retainer 126 retains the packing and electrical isolation items 106, 108, 110, 112, 114 and 124. The outside diameter of the packing gland ring 126 is threaded to mount to a lock nut 120 (as above) with a wiper ring 122 (as above) to hold the packing gland ring 126 within the horizontal conduit 86. At the outer end of the packing gland retainer 126, a nut 128 is used to attach to the electrical box 34. Rubber washers 130 and flat washer 132 seal between the nut 128 and the packing gland retainer 126.

Clamp Assembly

Figure 16:
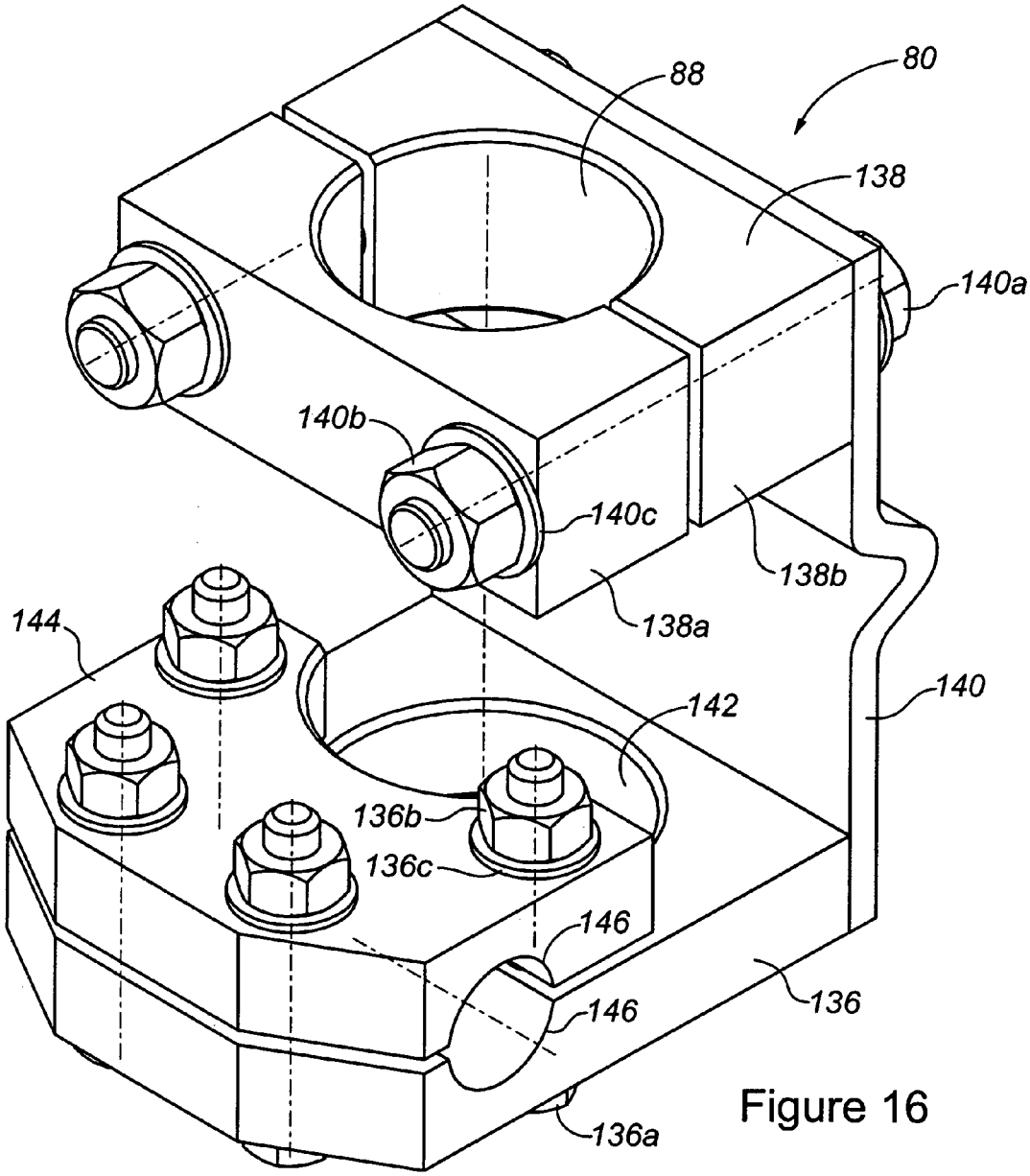
Figure 17:
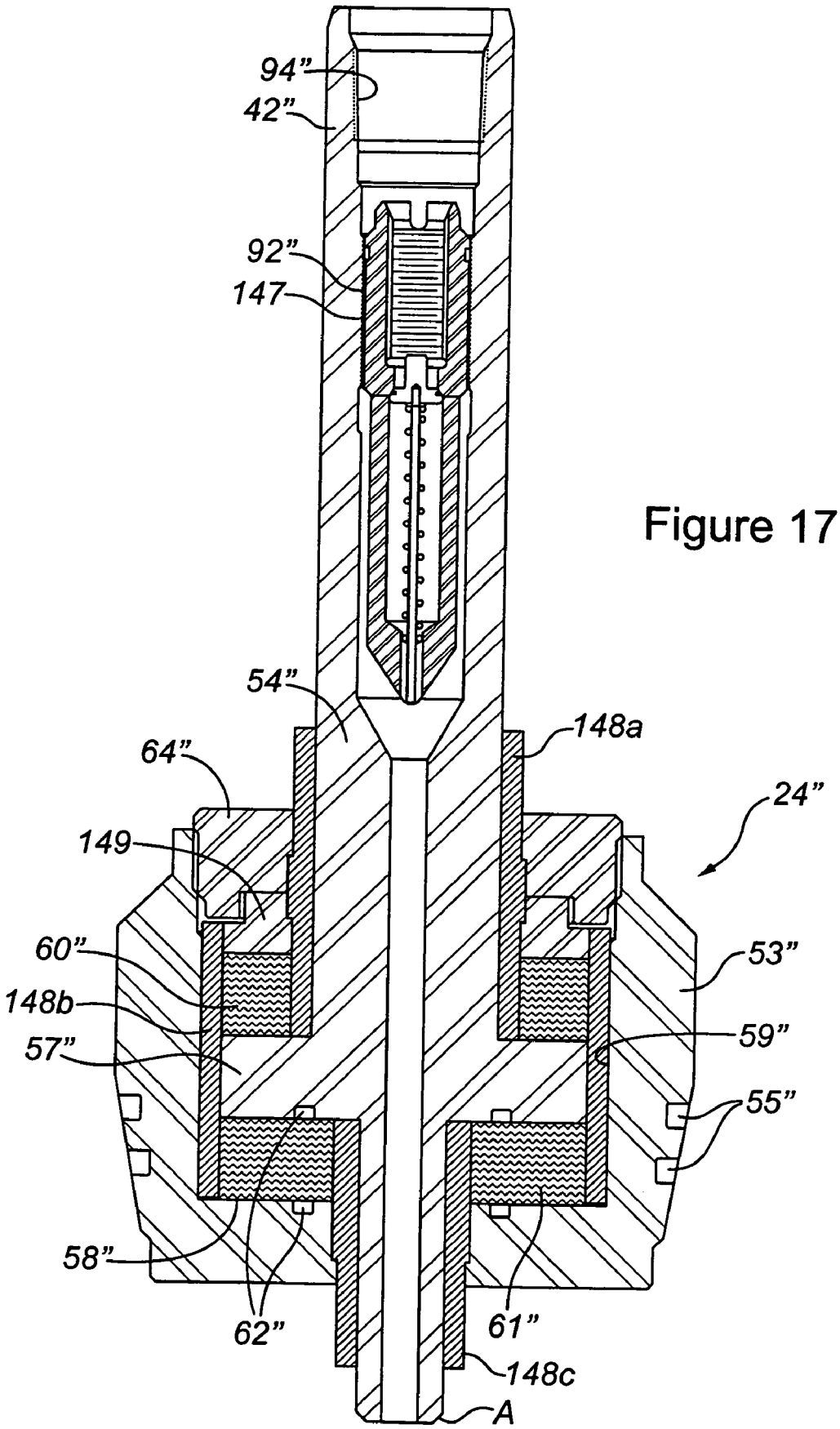
Figure 18:
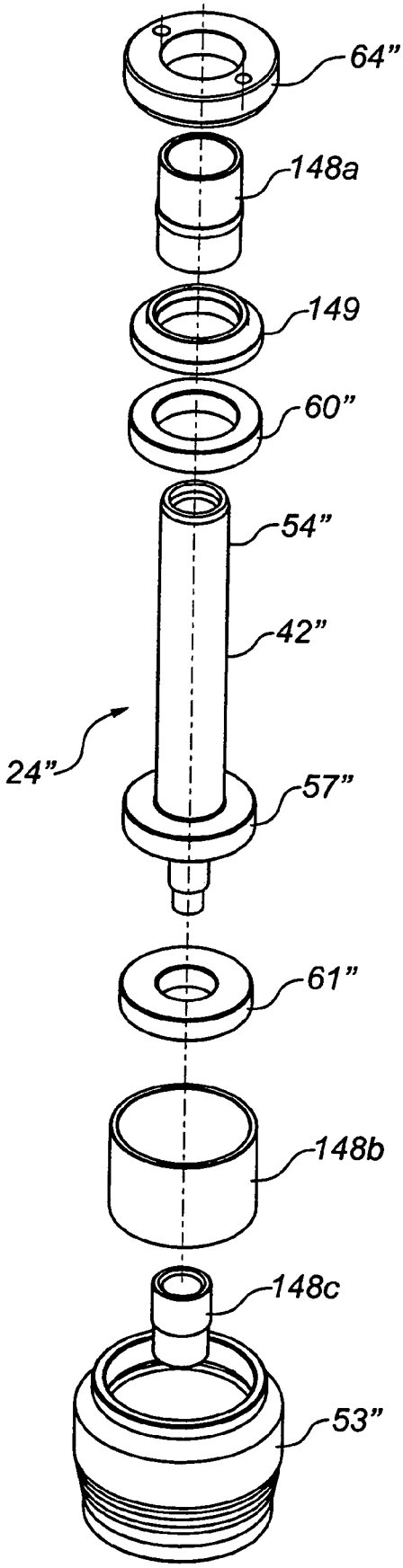
Figure 19:
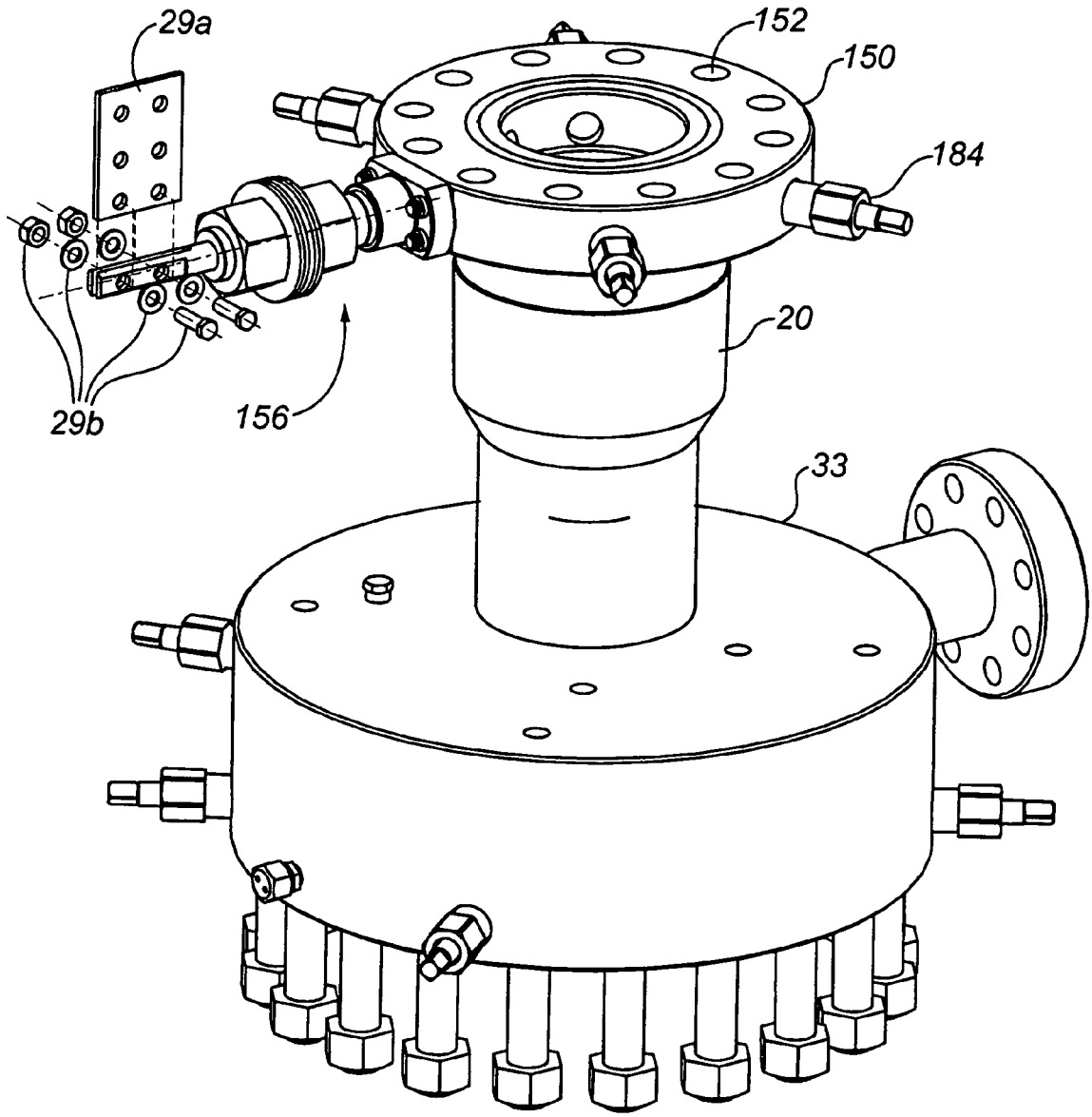
Figure 20:
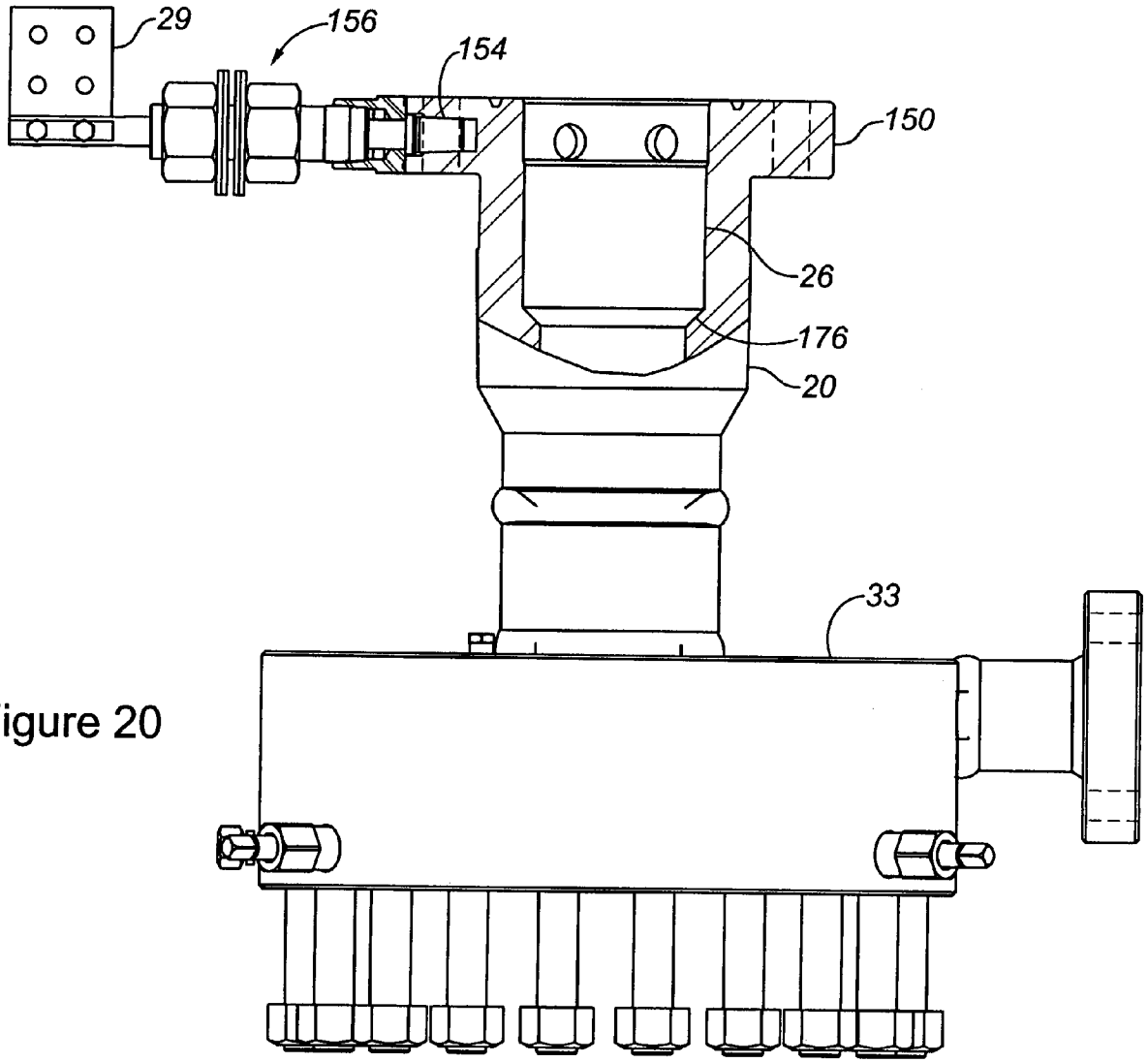

The clamp assembly 80 is held within the vertical bore 11 within an electrical isolation sleeve 134 (see FIG. 15), made for example from Teflon to provide electrical isolation between the clamp assembly 80 and the electrical spool 82. In FIG. 16, a preferred embodiment of the clamp assembly 80 includes a five-part clamp body made of electrically conductive material such as copper. This provides a clamp assembly 80 which is easy to assemble while being functional to clamp together, for direct electrical connection, the conductive rod 84 and the conducting portion of the tubing hanger 24". The clamp assembly 80 includes a bottom plate 136 and a top plate 138 connected by a side bracket 140. The top plate 138 is formed of two top plate portions 138*a*, 138*b* each of which includes a central semi-circular cutout portion (i.e., semi-circular in horizontal cross section) sized such that they together form a neck extension bore 88 for the neck extension 42" of the isolated tubing hanger 24". The top plate portions 138*a*, 138*b* are connected to each other by cap screws, bolts and washers 140*a*, 140*b*, 140*c*, so as to clamp to the neck extension 42" of the tubing hanger 24". The bottom plate 136 forms a circular cutout portion 142 sized to accept the neck extension 42" of the isolated tubing hanger 24". A middle plate 144 of the clamp assembly 80 is bolted (cap screws, bolts, washers 136*a*, 136*b* and 136*c*) above the bottom plate 136. Each of the middle and bottom plates 144,136 is formed with semi-circular groove 146 (i.e., semi-circular in vertical cross-section) for tight fitting relationship with the conductive rod 84. Thus, the clamp assembly 80, when positioned in the vertical bore 11 clamped around the neck extension 42" of the isolated tubing hanger 24" and the conductive rod 84, provides direct electrical connection from the conductive rod 84 through to the conducting tubing string 14 which is suspended from the neck extension 42", for example by welding.

The clamp assembly 80 is formed of electrically conductive material with low electrical resistance, such as copper, which may be tin plated for good electrical connection to the conductive rod 84 and the tubing hanger 24". The cap screw, bolts and washers (136 *a,b,c* and 140*a,b,c*) may be made of silicon bronze to provide good electrical conductivity.

While it is within the scope of the present invention to have the clamp assembly 80 directly onto the conducting tubing string 14, it more preferably clamps onto the neck extension 42" of the isolated tubing hanger 24", as described herein.

Isolated Tubing Hanger

The isolated tubing hanger 24" is similar to that shown for the first and second embodiments, except that the spacings for insulation purposes are replaced by insulation sleeves, as described below. The hanger 24" includes a pressure containing body housing 53", operative to land and seal within the tubing hanger profile 22" of the tubing head 18". Double O-ring seals 55" are provided in the external tapered surface of the housing 53" to seal in the vertical bore 11 of the tubing head 18". The housing 53" forms a central bore 59" extending there through with a landing seat 58" at its lower end. A generally cylindrical landing coupling 54" having a widened landing shoulder 57" seats in the central bore 59" on the landing seat 58". The conducting tubing string 14 is welded at A to the lower end of the landing coupling 54". Alternate connections for the conducting tubing string 14 may be used, for example slip lock or threaded connections, as are well known in the art, but welding is preferred for electrical conductivity.

The landing coupling 54" is made of an electrically conductive material with good strength. The upper end of the landing coupling 54" provides the upwardly extending neck extension 42" of the isolated tubing hanger 24" onto which the clamp assembly 80 is fastened. The landing coupling 54" forms a central bore 94" operative to pass well fluids. Formed in the central bore 94" within the neck extension 42" is a back pressure valve profile 92", top threaded for a back pressure valve (BPV) 147 which may be of known and varied design, but allows for the wellhead members located thereabove to be accessed while the well is under pressure. In the Figures the back pressure valve is shown as a Type H one way BPV (threaded in), but alternate one way or two way BPVs may be used, as known in the art. The provision of this back pressure valve in the isolated tubing hanger 24" also allows for connection of the clamp assembly 80 for the hot electrical connection while the wellhead is under pressure.

In order to electrically isolate the landing coupling 54" from the housing 53", upper, mid and lower insulating sleeves 148*a*, 148*b*, 148*c*, made for example from Teflon®, are provided between landing coupling 54" and the housing 53". As well, upper and lower electrical insulation plates 60", 61" made from, for example, a PEEK material for electrical isolation and strength, are provided above and below the landing shoulder 57" of the landing coupling 54". An externally threaded retainer ring 64" threads into the central bore 59" at the top of the housing 53" against a packing ring 149 to retain all internal components in the housing 53" in electrically isolated and sealing arrangement. O-ring seals 62" are provided above and below the lower electrical insulation plate 61" to provide a seal between the landing coupling 54" and the housing 53".

Neutral or Grounding Connection

The neutral or grounding connection tubing head 20 is shown in FIGS. 19-22. As generally noted above, the wellhead body members could be provided as a single member. Here, the grounding tubing head 20 could be formed one piece with the tubing head 18", but is shown as a separate member in this preferred embodiment. The top flange 150 of the grounding tubing head 20 is shown with studded up connections 152 to the tubing head 18' located thereabove. The bottom portion of the tubing head 20 provides connection to well known surface casing and associated wellhead equipment shown generally at 33, which does not concern the present invention. The intermediate portion of the tubing head 20 forms a tubing hanger profile 26 in its central vertical wellbore 11, to support and seal to the grounding or neutral connection tubing hanger 28, which in turn in operative to suspend the grounding tubing string 16, attached for example by welding at the lower end of the tubing hanger 28.

The top flange 150 of the tubing head 20 is formed with a receptacle 154 proximate the grounding tubing hanger 28. A neutral rod connection assembly 156 connected to grounding connection assembly 29, is held in the receptacle 154 to provide a grounding connection to the grounding tubing string 16, thus grounding the tubing head 20.

The neutral rod connection assembly 156 includes an electrically conducting grounding rod 158, which may for example be made from tin plated copper rod for low electrical resistance. The grounding rod 158 transfers electrical current from the grounding tubing head 20 (and the hanger 28 and tubing string 16) to the ground connection assembly plate 29*a*, as above described. The rod 158 is bolted to the plate 29*a* by nut and bolt connectors 29*b* (see FIG. 19). A protector sleeve 160 surrounds the grounding rod 158 to protect it from the environment. The sleeve 160 is threaded into an internally threaded mounting ring 162, which in turn is bolted onto the top flange 150 of the tubing head 20. Nuts 164*a*, steel washers 164*b* and rubber washers 164*c* fasten around the grounding rod 158 to the electrical junction box 34 (shown in outline in FIG. 22). An O-ring seal 166 is included between the mounting ring 162 and the top flange 150. A further O-ring seal 168 is provided between the protector sleeve 160 and the grounding rod 158 on the junction box side.

Figure 21:
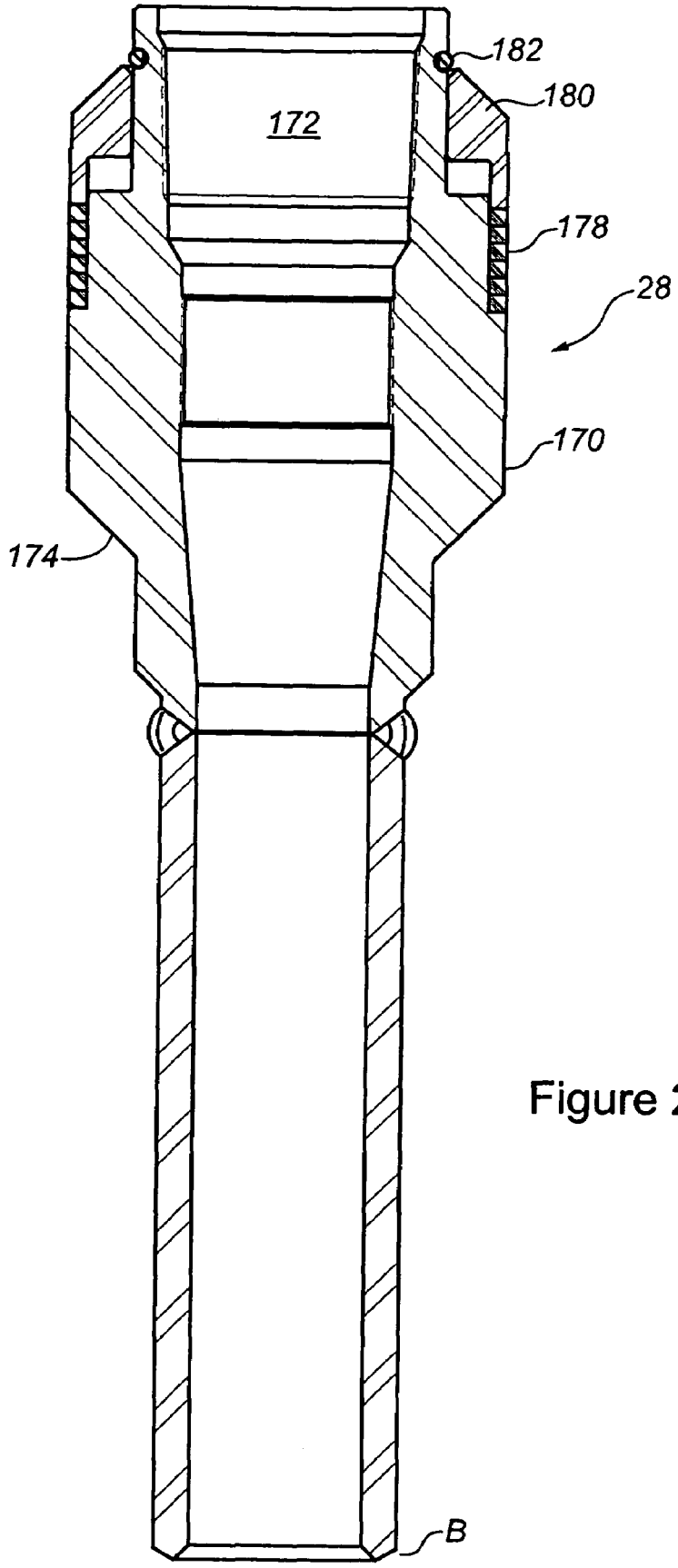
Figure 22:
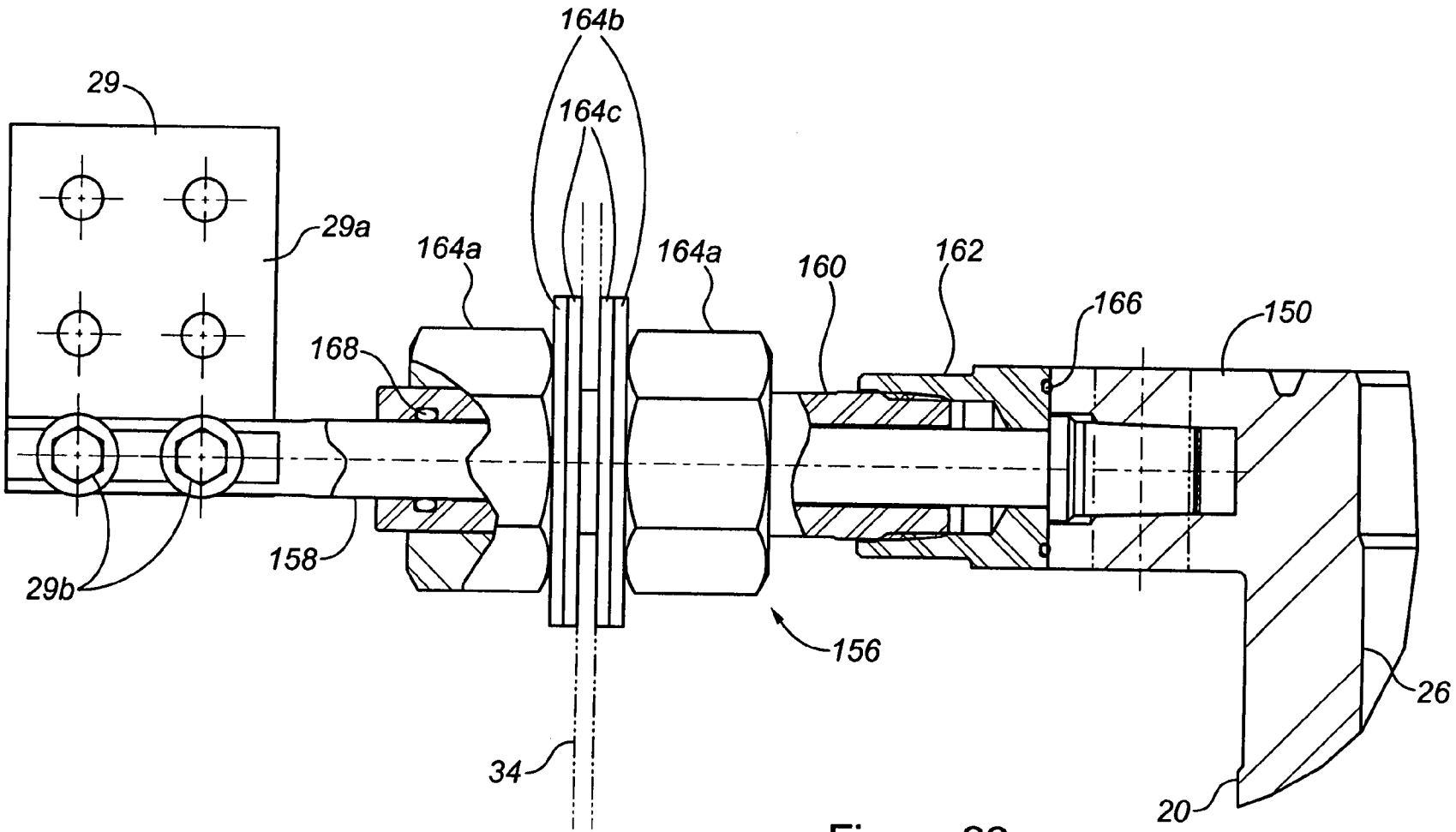

The grounding tubing hanger 28 is best shown in FIG. 21 to include a pressure containing body 170 formed with an internal bore 172 threaded and sized to accept a back pressure valve (not shown) and an external profile to mate with the tubing hanger profile 26 of the tubing head 20. This external profile includes a load shoulder 174 to seat within an inwardly extending circumferential seat 176 in the tubing hanger profile 26 of the tubing head 20. This load shoulder 174 and seat 176 provide the primary electrical contact between the tubing hanger 28 and the tubing head 20. The grounding tubing string 16 is connected at the bottom of the tubing hanger 28 by welding at B. Alternates modes of connecting the grounding tubing string 16 such as slip lock connections or threaded connection may be used, but welding is preferred for electrical conductivity reasons. The grounding tubing hanger 28 carries a plurality of packing rings 178 formed for example of conductive Grafoil® (95% carbon) held in place by a top ring 180 and a retainer ring 182. The top ring 180 moves downwardly against the packing rings 178 when a plurality of tubing head lockscrews 184, extending through the top flange 150 of the tubing head 20 in are tightened.

Fourth Embodiment

Figure 23:
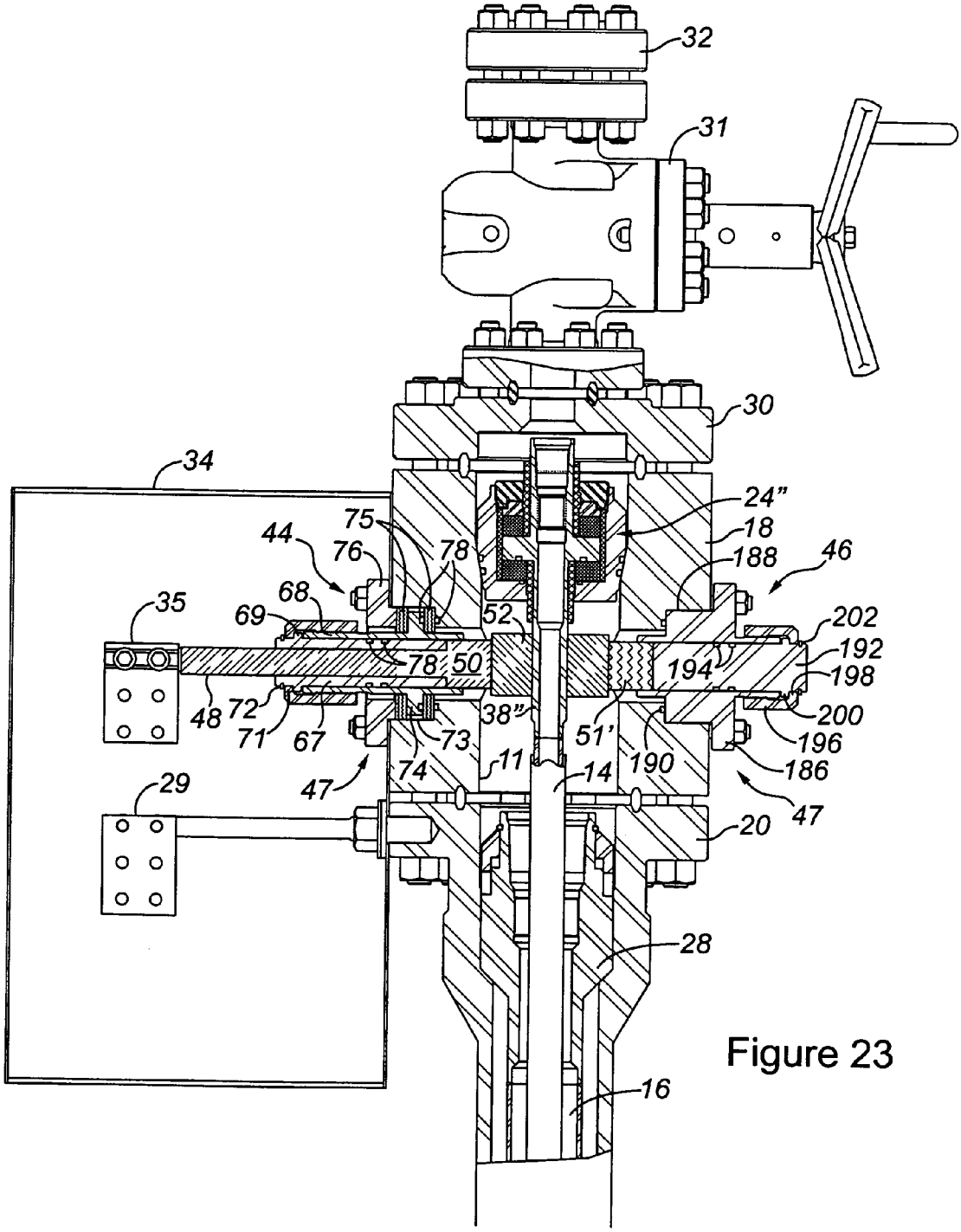
FIG. 23 is a side view, partially in section of a fourth embodiment of the invention, in which a ram connection is used for the hot electrical connection, but wherein the isolated tubing hanger from the third embodiment is somewhat modified for use with the ram connection, and wherein the supporting ram assembly includes a ram formed of insulating material.

Ram Connection, FIG. 23

FIG. 23 shows a ram connection of the present invention utilizing the isolated tubing hanger 24" of the third embodiment, but having a downwardly extending neck extension 38" as described for the first embodiment for hot connection to the ram assemblies 44, 46. This embodiment also differs from the first embodiment in that the electrical isolation assembly 47 on the support ram assembly 46 is simplified by reason of the head of the support ram 51' being itself formed of an electrical insulating material such as PEEK. Compared to the first embodiment, the function of the ram housing is now provided in the fourth embodiment by an altered support retainer ring 186 bolted to the outer wall of the tubing head 18, and sealed in the seal pocket 188 with O-ring seal 190. The support actuation rod 192 is sealed through O-ring seals 194 within the support retainer ring 186. The actuation nut 196 is fixed around the end of the support actuation rod 192, with the inner lip 198 of the nut 196 being held between outwardly extending rings 200, 202 fixed to or integral with the support actuation rod 192. The actuation nut 196 is threaded onto the outwardly protruding end of the support retainer ring 186, such that engaging and disengaging the threads on the nut 196 extends and retracts the support actuation rod 192 and thus the ram 51' against the conducting ring 52 in the vertical bore 11. The conductive rod assembly 44 and its isolation assembly 47 are as described in the first embodiment, and are thus labeled as for the first embodiment in FIG. 23.

All publications mentioned in this specification are indicative of the level of skill in the art of this invention. All publications are herein incorporated by reference to the same extent as if each publication was specifically and individually indicated to be incorporated by reference.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow.

We claim:

1. A wellhead assembly for providing a power connection to a downhole electrical device, comprising:

one or more pressure-containing wellhead body members enclosing a vertical wellbore extending there through, the one or more body members forming separate first and second tubing hanger profiles to support in sealed and vertically stacked relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being formed of an electrically conductive material and being electrically connected to the downhole electrical device;

the isolated tubing hanger having an outer housing which seats in the first tubing hanger profile, an inner electrically conducting portion supported by the outer housing operative to provide electrical connection to, and suspend, the conducting tubing string, the inner electrically conducting portion including a conducting neck portion extending upwardly relative to the outer housing of the isolated tubing hanger, and insulation between the outer housing and the inner electrical conducting portion to electrically isolate the housing portion from the conducting portion;

the one or more wellhead body members forming a conduit to provide access to the vertical wellbore proximate the isolated tubing hanger for electrical connection to the conducting tubing string;

a hot electrical connection extending through the conduit for making an electrical connection through to the conducting tubing string in the vertical wellbore, said hot electrical connection including a conductive rod connected at one end to the first connection of the source of current, and at the other end to a clamp assembly, said clamp assembly being operative to clamp together, for electrical connection within the vertical wellbore, the conductive rod and the conducting neck portion of the isolated tubing hanger, and wherein both the conductive rod and the clamp assembly are formed of electrically conductive materials;

electrical isolation associated with the hot electrical connection for sealing and electrically isolating the hot electrical connection in the conduit such that the one or more wellhead body members remain electrically isolated;

a grounding connection connected to the one or more wellhead body members proximate the grounding tubing hanger for making a ground connection to the grounding tubing string;

a source of current having a first connection to the hot electrical connection and a second connection to the grounding connection; and wherein the isolated tubing hanger is located vertically above the grounding tubing hanger, wherein the conducting tubing string suspended from the isolated tubing hanger is the inner of the concentrically arranged tubing strings, and wherein the isolated tubing hanger includes a back pressure valve such that the vertical wellbore located thereabove may be accessed while the vertical wellbore located therebelow is under pressure.

2. The assembly as set forth in claim 1, wherein the one or more wellhead body members includes a separate electrical feed through spool and a tubing head, the electrical feed through spool being connected and sealed above the tubing head, the electrical feed through spool forming the conduit for the hot electrical connection and the electrical isolation associated therewith, and the tubing head being operative to support the isolated tubing hanger.

3. The assembly as set forth in claim 2, wherein the clamp assembly includes an electrically insulating sleeve located to surround the clamp assembly.

4. The assembly as set forth in claim 3, wherein the one or more wellhead body members forms a receptacle in its wall proximate the grounding tubing hanger, and wherein the grounding connection includes a grounding rod having one end extending into the receptacle and the other end connected to the second connection of the source of current.

5. The assembly as set forth in claim 4, wherein the one or more wellhead body members includes a separate grounding tubing head connected below the tubing head for the isolated tubing hanger, the grounding tubing head being operative to support the grounding tubing hanger, and the receptacle being formed in the grounding tubing head proximate the grounding tubing hanger.

6. The assembly as set forth in claim 4, wherein the grounding tubing hanger includes a back pressure valve such that the vertical wellbore located thereabove may be accessed while the vertical wellbore located therebelow is under pressure.

7. The assembly as set forth in claim 4, wherein isolated tubing hanger further comprises:

the housing forming a central bore with an inwardly extending circumferential landing seat at its lower end, and carrying outer circumferential seals to seal with the tubing head for the isolated tubing hanger;

the conducting portion of the isolated tubing hanger including:

a landing shoulder to seat on the landing seat, the conducting portion forming a central bore extending there through and having a profile to support and seal therein a back pressure valve, and a conducting neck portion integral with the conducting portion extending upwardly or downwardly relative to the housing, said neck portion providing the electrical connection to the conducting tubing string;

the insulation including load supporting insulation plates located above and below the landing shoulder, and a plurality of insulation sleeves between the housing and the conducting portion;

one or more seals between the landing shoulder and the landing seat to seal the conducting portion of the isolated tubing hanger with the housing; and a retainer ring at the top of the housing around the neck portion to retain, seal and energize the insulation and the one or more seals.

8. The assembly as set forth in claim 4, wherein the one or more wellhead body members includes, as its uppermost member, a tubing head adaptor located above the tubing hanger for the isolated tubing hanger, and providing a spacing in its vertical wellbore around the isolated tubing hanger to assist in electrical isolation.

9. A wellhead assembly for providing a power connection to a downhole electrical device, comprising:

one or more pressure-containing wellhead body members enclosing a vertical wellbore extending there through, the one or more body members forming separate first and second tubing hanger profiles to support in sealed and vertically stacked relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being formed of an electrically conductive material and being electrically connected to the downhole electrical device;

the isolated tubing hanger having an outer housing which seats in the first tubing hanger profile, an inner electrically conducting portion supported by the outer housing operative to provide electrical connection to, and suspend, the conducting tubing string, and insulation between the housing and the conducting portion to electrically isolate the housing portion from the conducting portion;

the one or more wellhead body members forming a conduit to provide access to the vertical wellbore proximate the isolated tubing hanger for electrical connection to the conducting tubing string;

a hot electrical connection extending through the conduit for making an electrical connection through to the conducting tubing string in the vertical wellbore;

electrical isolation associated with the hot electrical connection for sealing and electrically isolating the hot electrical connection in the conduit such that the one or more wellhead body members remain electrically isolated;

a grounding connection connected to the one or more wellhead body members proximate the grounding tubing hanger for making a ground connection to the grounding tubing string;

a source of current having a first connection to the hot electrical connection and a second connection to the grounding connection;

wherein the one or more wellhead body members includes a separate tubing head to support the isolated tubing hanger, the isolated tubing hanger is located vertically above the grounding tubing hanger, the conducting tubing string suspended from the isolated tubing hanger is the inner of the concentrically arranged tubing strings, and the conducting portion of the isolated tubing hanger includes a conducting neck portion extending downwardly relative to the housing of the isolated tubing hanger, said neck portion providing the electrical connection; and wherein the hot electrical connection includes two diametrically opposing horizontal reciprocating rams in the conduit, the first including a conducting ram and the second including a supporting ram, the conducting ram being connected at one end to the first connection of the source of current and its other end located to make electrical contact when in an extended position to the conducting neck portion of the isolated tubing hanger in the vertical wellbore and to break the electrical contact when in the retracted position, and the supporting ram, in an extended position, providing an opposing balancing force to the conducting ram.

10. The assembly as set forth in claim 9, wherein a conducting ring is provided on the downwardly extending neck portion of the isolated tubing hanger, wherein the conducting and supporting rams make electrical contact to the conducting ring when in their extended positions.

11. The assembly as set forth in claim 10, wherein the isolated tubing hanger includes a back pressure valve located in its central bore.

12. The assembly as set forth in claim 10, wherein the one or more wellhead body members forms a receptacle in its wall proximate the grounding tubing hanger, and wherein the grounding connection includes a grounding rod having one end extending into the receptacle and the other end connected to the second connection of the source of current.

13. The assembly as set forth in claim 12, wherein the one or more wellhead body members includes a separate grounding tubing head connected below the tubing head for the isolated tubing hanger, the grounding tubing head being operative to support the grounding tubing hanger, and the receptacle being formed in the grounding tubing head proximate the grounding tubing hanger.

14. The assembly as set forth in claim 12, wherein the grounding tubing hanger includes a back pressure valve such that the vertical wellbore located thereabove may be accessed while the vertical wellbore located therebelow is under pressure.

15. The assembly as set forth in claim 12, wherein isolated tubing hanger further comprises:

the housing forming a central bore with an inwardly extending circumferential landing seat at its lower end, and carrying outer circumferential seals to seal with the tubing head for the isolated tubing hanger;

the conducting portion of the isolated tubing hanger including:

a landing shoulder to seat on the landing seat, the conducting portion forming a central bore extending there through and having a profile to support and seal therein a back pressure valve, and a conducting neck portion integral with the conducting portion extending upwardly or downwardly relative to the housing, said neck portion providing the electrical connection to the conducting tubing string;

the insulation including load supporting insulation plates located above and below the landing shoulder, and a plurality of insulation sleeves between the housing and the conducting portion;

one or more seals between the landing shoulder and the landing seat to seal the conducting portion of the isolated tubing hanger with the housing; and a retainer ring at the top of the housing around the neck portion to retain, seal and energize the insulation and the one or more seals.

16. A wellhead assembly for providing a power connection to a downhole electrical device, comprising:

one or more pressure-containing wellhead body members enclosing a vertical wellbore extending there through, the one or more body members forming separate first and second tubing hanger profiles to support in sealed and vertically stacked relationship in the vertical wellbore, an isolated tubing hanger and a grounding tubing hanger, the isolated tubing hanger suspending therefrom a conducting tubing string, and the grounding tubing hanger suspending therefrom a grounding tubing string concentrically spaced from the conducting tubing string, both of the tubing strings being formed of an electrically conductive material and being electrically connected to the downhole electrical device;

the isolated tubing hanger having an outer housing which seats in the first tubing hanger profile, an inner electrically conducting portion supported by the outer housing operative to provide electrical connection to, and suspend, the conducting tubing string, and insulation between the housing and the conducting portion to electrically isolate the housing portion from the conducting portion;

the one or more wellhead body members forming a conduit to provide access to the vertical wellbore proximate the isolated tubing hanger for electrical connection to the conducting tubing string;

a hot electrical connection extending through the conduit, for making an electrical connection through to the conducting tubing string in the vertical wellbore;

electrical isolation associated with the hot electrical connection for sealing and electrically isolating the hot electrical connection in the conduit such that the one or more wellhead body members remain electrically isolated;

a grounding connection connected to the one or more wellhead body members proximate the grounding tubing hanger for making a ground connection to the grounding tubing string;

a source of current having a first connection to the hot electrical connection and a second connection to the grounding connection; and the one or more wellhead body members forming a receptacle in its wall proximate the grounding tubing hanger, and the grounding connection including a grounding rod having one end extending into the receptacle and the other end connected to the second connection of the source of current.

17. The assembly as set forth in claim 16, wherein the grounding tubing hanger includes a back pressure valve such that the vertical wellbore located thereabove may be accessed while the vertical wellbore located therebelow is under pressure.

18. A hot electrical connection assembly in a wellhead for providing a power connection to a tubing string extending to a downhole electrical device, comprising:

one or more pressure-containing Wellhead body members enclosing a vertical wellbore extending there through, the one or more body members forming a first tubing hanger profile to support and seal in the vertical wellbore, an isolated tubing hanger, the isolated tubing hanger suspending therefrom a conducting tubing string electrically connected to the downhole electrical device;

the isolated tubing hanger having an outer housing which seats in the first tubing hanger profile, an inner electrically conducting portion supported by the outer housing operative to provide electrical connection to, and suspend, the conducting tubing string, and insulation between the housing and the conducting portion to electrically isolate the housing portion from the conducting portion;

the one or more wellhead body members forming a conduit to provide access to the vertical wellbore proximate the isolated tubing hanger for electrical connection to the conducting tubing string;

hot electrical connection extending through the conduit for making an electrical connection through to the conducting tubing string in the vertical wellbore, said hot electrical connection including a conductive rod connected at one end to a source of current, and at the other end to a conducting clamp assembly, said clamp assembly being operative to clamp together, for electrical connection within the vertical wellbore, the conductive rod and either the conducting tubing string or the conducting portion of the isolated tubing hanger;

electrical isolation associated with the hot electrical connection for sealing and electrically isolating the hot electrical connection in the conduit such that the one or more wellhead body members remain electrically isolated;

wherein the conducting portion of the isolated tubing hanger includes an upwardly extending neck portion relative to the housing of the isolated tubing hanger, said neck portion being the portion of the isolated tubing hanger which is clamped by the clamp assembly to the conductive rod; and wherein the isolated tubing hanger includes a back pressure valve such that the vertical wellbore located thereabove may be accessed while the vertical wellbore located therebelow is under pressure.

19. The hot electrical connection assembly as set forth in claim 18, wherein the one or more wellhead body members includes a separate electrical feed through spool and a tubing head, the electrical feed through spool being connected and sealed above the tubing head, the electrical feed through spool forming the conduit for the hot electrical connection and the electrical isolation associated therewith, and the tubing head being operative to support the isolated tubing hanger.

20. A hot electrical connection assembly in a wellhead for providing a power connection to a tubing string extending to a downhole electrical device, comprising:

one or more pressure-containing wellhead body members enclosing a vertical wellbore extending there through, the one or more body members forming a first tubing hanger profile to support and seal in the vertical wellbore, an isolated tubing hanger, the isolated tubing hanger suspending therefrom a conducting tubing string electrically connected to the downhole electrical device;

the isolated tubing hanger having an outer housing which seats in the first tubing hanger profile, an inner electrically conducting portion supported by the outer housing operative to provide electrical connection to, and suspend, the conducting tubing string, and insulation between the housing and the conducting portion to electrically isolate the housing portion from the conducting portion;

the one or more wellhead body members forming a conduit to provide access to the vertical wellbore proximate the isolated tubing hanger for electrical connection to the conducting tubing string;

hot electrical connection extending through the conduit for making an electrical connection through to the conducting tubing string in the vertical wellbore, the hot electrical connection including at least one reciprocating horizontal ram in the conduit, the ram having a conductive rod end connected to a source of current and a ram end to make the electrical connection to the conducting tubing string when in an extended position, and to break the electrical connection when in a retracted position;

electrical isolation associated with the hot electrical connection for sealing and electrically isolating the hot electrical connection in the conduit such that the one or more wellhead body members remain electrically isolated;

wherein the one or more wellhead body members includes a separate tubing head to support the isolated tubing hanger, and wherein the conducting portion of the isolated tubing hanger includes a conducting neck portion extending downwardly relative to the housing of the isolated tubing hanger, said neck portion providing the electrical connection to the horizontal ram; and wherein the hot electrical connection includes two diametrically opposing horizontal reciprocating rams in the conduit, the first including a conducting ram and the second including a supporting ram, the conducting ram being connected at its one end to the source of current and its other end located to make electrical contact when in an extended position to the neck portion of the isolated tubing hanger in the vertical wellbore, and the supporting ram, in an extended position, providing an opposing balancing force to the conducting ram.

21. The hot electrical connection assembly as set forth in claim 20, wherein a conducting ring is provided on the downwardly extending neck portion of the isolated tubing hanger, wherein the conducting and supporting rams make electrical contact to the conducting ring when in their extended positions.

22. The hot electrical connection assembly as set forth in claim 21, wherein the isolated tubing hanger includes a back pressure valve located in its central bore.

23. An isolated tubing hanger for suspending a conducting tubing string within a tubing head, the isolated tubing hanger comprising:

an outer housing which seats in the tubing head, an inner electrically conducting portion supported by the outer housing operative to provide electrical connection to, and suspend, the conducting tubing string, and insulation between the housing and the conducting portion to electrically isolate the housing portion from the conducting portion;

the housing forming a central bore with an inwardly extending circumferential landing seat at its lower end, and carrying outer circumferential seals to seal with the tubing head;

the conducting portion of the isolated tubing hanger including a landing shoulder to seat on the landing seat, a central bore extending there through and having a profile to support and seal therein a back pressure valve, and a conducting neck portion integral with the conducting portion extending upwardly or downwardly relative to the housing, said neck portion providing the electrical connection to the conducting tubing string;

the insulation including load supporting insulation plates located above and below the landing shoulder, and a plurality of insulation sleeves between the housing and the conducting portion;

one or more seals between the landing shoulder and the landing seat to seal the conducting portion of the isolated tubing hanger with the housing; and a retainer ring at the top of the housing around the neck portion to retain, seal and energize the insulation and the one or more seals.

24. A method for providing a power connection from a source of current located at a wellhead to a downhole electrical device, the method comprising:

providing one or more pressure-containing wellhead body members forming a vertical wellbore extending there through, the one or more wellhead body members forming first and second tubing hanger profiles to support, in sealed relationship in the vertical wellbore, a first and a second tubing hanger in vertically stacked relationship in the vertical wellbore, each tubing hanger being operative to suspend there from a tubing string such that a first and a second tubing string are concentrically spaced from each other;

providing a conduit in the one or more wellhead body members for access to the vertical wellbore proximate the first tubing hanger;

providing electrical isolation to the first of the tubing hangers such that an outer housing of the first tubing hanger is electrically isolated from an inner, electrically conducting portion of the first tubing hanger, the electrically conducting portion of the first tubing hanger including a conducting neck portion extending upwardly relative to the outer housing of the first tubing hanger;

suspending the first tubing string from the electrically conducting portion of the first tubing hanger;

providing insulation between the outer housing and the inner conducting portion of the first tubing hanger to electrically isolate the outer housing portion from the inner conducting portion;

connecting the source of current through the conduit in a sealed and electrically isolated manner to the conducting neck portion by an electrically conductive clamp clamped to the conducting neck portion of the first tubing hanger or to the first tubing string, such that the one or more wellhead members are electrically isolated from the first tubing string; and connecting the source of current to the one or more wellhead body members so as to provide a grounding connection to the second tubing string.

25. The method as set forth in claim 24, wherein the source of current is connected to the one or more wellhead body members at a location proximate the second tubing hanger so as to provide the grounding connection to the second tubing string.

26. An isolated tubing hanger for suspending a conducting tubing string within a pressure-containing tubing head, the isolated tubing hanger comprising:

an outer housing which seats in the tubing head, an inner electrically conducting portion supported by the outer housing operative to provide electrical connection to, and suspend, the conducting tubing string, and insulation between the housing and the conducting portion to electrically isolate the housing portion from the conducting portion;

the housing forming a central bore with an inwardly extending circumferential landing seat at its lower end, and carrying outer circumferential seals to seal with the tubing head;

the conducting portion of the isolated tubing hanger including a landing shoulder to seat on the landing seat, and a conducting neck portion connected to, or integral with, the conducting portion extending upwardly relative to the housing, said conducting neck portion providing the electrical connection to the conducting tubing string;

the insulation including load supporting insulation plates located above and below the landing shoulder, and a plurality of insulation sleeves between the housing and the conducting portion;

one or more seals between the landing shoulder and the landing seat to seal the conducting portion of the isolated tubing hanger with the housing; and a retainer ring at the top of the housing around the conducting neck portion to retain, seal and energize the insulation and the one or more seals.

* * * * *